United States Patent [19]

Perlman

[11] Patent Number: 5,043,714

[45] Date of Patent: Aug. 27, 1991

[54] VIDEO DISPLAY APPARATUS

[75] Inventor: Stephen G. Perlman, Mountain View, Calif.

[73] Assignee: Apple Computer, Inc., Cupertino, Calif.

[21] Appl. No.: 152,959

[22] Filed: Feb. 5, 1988

Related U.S. Application Data

[62] Division of Ser. No. 870,451, Jun. 4, 1986, Pat. No. 4,868,557.

[51] Int. Cl.[5] ..... G09G 1/14

[52] U.S. Cl. ..... 340/750; 340/703; 340/799

[58] Field of Search ..... 340/701, 702, 703, 747, 340/750, 799; 364/518, 519, 521

[56] References Cited

U.S. PATENT DOCUMENTS

| | | | |
|---|---|---|---|
| 4,308,532 | 12/1981 | Murphy | 340/750 |
| 4,418,344 | 11/1983 | Brown | 340/750 |
| 4,554,538 | 11/1985 | Bieneman | 340/703 |
| 4,700,181 | 10/1987 | Maine et al. | 340/747 |

*Primary Examiner*—Jeffery A. Brier
*Assistant Examiner*—M. Fatahiyar
*Attorney, Agent, or Firm*—Blakely, Sokoloff, Taylor & Zafman

[57] ABSTRACT

A video display apparatus for composing video signals for a raster scanned display on a line-by-line basis. Objects are stored in a video RAM and are packed in the RAM without regard to their location on the display. A separate dispatch table contains information on each object and commands. A dispatcher operates on this information, allowing lines of data and commands to be extracted from the RAM as each video line is composed in a buffer.

2 Claims, 19 Drawing Sheets

Fig. 2c
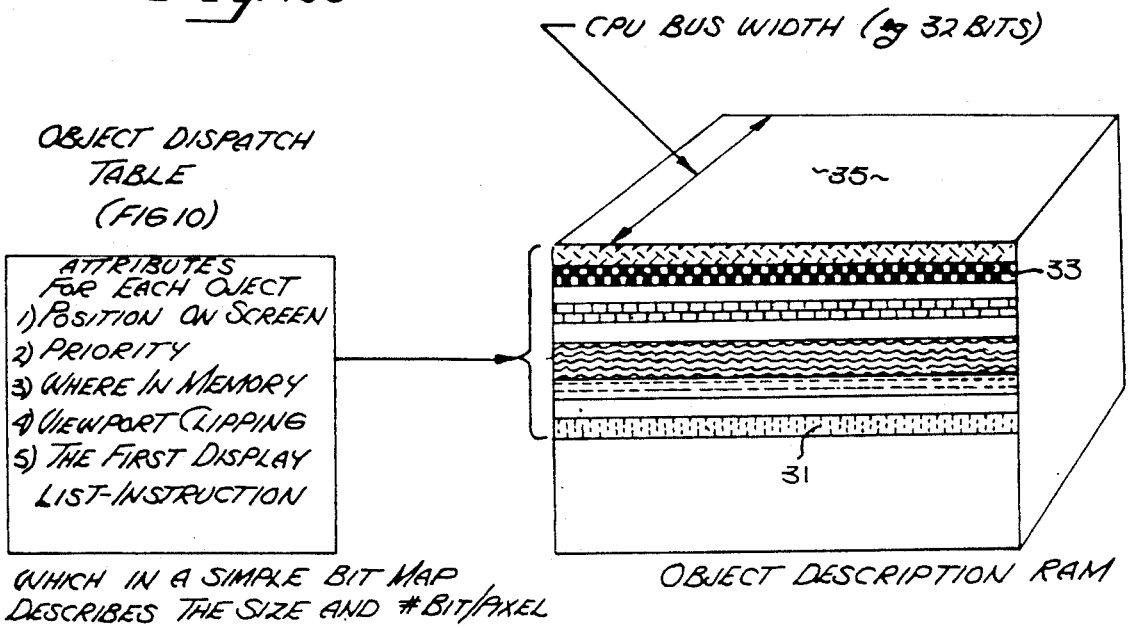
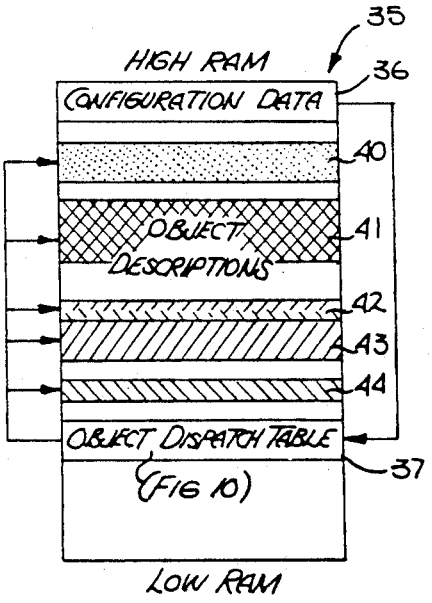
Fig. 3

LAYOUT OF LINE BUFFERS

LINE BUFFER MEMORY CELL

FOR MEMORY CELL GROUP ZERO

LINE BUFFER CONTROLLER

DISPATCHER

VERTICAL VIEWPORT

HORIZONTAL SCROLLING

EMBEDDED MASK

Command Word Format

VIDEO DISPLAY APPARATUS

This is a divisional of application Ser. No. 870,451 filed June 4, 1986 now U.S. Pat. No. 4,868,557.

BACKGROUND OF THE INVENTION

1. Field of the Invention

The invention relates to the field of video displays and in particular, the processing of data to generate video signals.

2. Prior Art

There are numerous commercial systems and many others described in printed publications for providing an interface between a digital computer and a raster scanned video display. The conversion of the computer's digital information into the pixel data used by a conventional raster scanned CRT requires considerable data manipulation, particularly for a complex color graphics. In many personal computers a substantial portion of the microprocessor's time is spent manipulating data just for this purpose, since an enormous amount of data is typically moved to generate each frame. The enormity of the problem can be appreciated by the fact that with current techniques, to produce a graphics display having the quality of, for example, a 35 mm film, requires computational power far beyond that of current microprocessors and indeed, beyond that of many mini-computers and mainframe computers for reasonable interactive performance.

There has been a great deal of emphasis on developing circuitry which will provide enhanced displays, through use of special purpose circuitry, "graphics engines" and the like without placing additional burdens on the computer's CPU. The present invention falls into this category in that it provides a graphics engine which, while operating under the general control of a CPU, generates the pixel data substantially independent of the CPU.

In many current graphics systems a bit map memory (e.g., frame buffer) is used to store the pixel data before the data is displayed. The data within these memories is moved for each frame often under the control of the CPU. In some cases, the pixel data is composed within the frame buffer and, for example, data may be written into the same locations several times to obtain the final pixel data. A typical frame buffer is described in conjunction with FIG. 2*b*, and the difference between this prior art storage technique and the present invention is described in conjunction with FIG. 2*c*.

In general, the present invention provides an improved graphics display by relying upon additional memory capacity rather than processing speed. It is believed that with the continuing decline in memory costs, this approach is considerably more economical than relying upon increased processing speed. Indeed, over the last few years the cost of storage in terms of cents per bit has decreased at a far greater rate than the speed of microprocessors or the cost of obtaining faster processing.

SUMMARY OF THE INVENTION

An improved video display apparatus for providing pixel data for a CRT display or the like is described. A first memory is used for storing the data representative of a plurality of objects intended to be displayed. The data for each object is stored in contiguously accessible locations in this first memory. There is arbitrary petitioning in this first memory for each of the objects, that is, one object may be stored in a different number of locations than another object. A second memory, which may be included in the first memory, is used for storing attributes for each of the objects. These attributes may include such information as screen position, object's priority (from background to foreground), object's location in the first memory, view port clipping and an instruction for the first line of display of that object. As currently preferred, both the first and second memories comprise a single memory. This single memory has dual data ports, one port for providing serial words to the buffer and the other for receiving data from a CPU.

A line buffer is used for composing each line of video data. As currently preferred, double line buffers are used to provide a continuous flow of video pixel data.

A first control means (dispatcher) receives the attributes from the second memory and controls the accessing of the data in the first memory. A second control means (line buffer controller) controls the loading of the data into the line buffer. In some cases, instructions are stored within the first memory along with the data and both the first and second controllers are responsive to these instructions.

In general, in operation one line of data for each object is read into the line buffer to compose a line of pixel data for the display.

The buffer itself is organized into a plurality of cells in such a way that data can be transferred at a faster rate where, for example, one bit per pixel is used when compared to a case where several bits are used to define a single pixel. The data in the line buffer can represent for each pixel, different types of pixel data, for instance, RGB data or an index in a color lookup table. Moreover, the line buffer provides for masking, allowing arbitrarily shaped objects to be displayed.

Other aspects of the present invention and its operation are described in the detailed description of the invention.

BRIEF DESCRIPTION OF THE DRAWINGS

FIG. 2*c* is a diagram used to describe the manner in which the data needed to display the objects of FIG. 2*a* are stored in memory in accordance with the present invention. This figure also shows the contents of a typical object dispatch table.

FIG. 3 is a diagram used to illustrate the storage of configuration data, dispatch table data and object data.

DETAILED DESCRIPTION OF THE INVENTION

A video display apparatus for providing pixel data for a raster scanned display is described. In the following description, numerous specific details are set forth such as specific number of bits, etc., in order to provide a thorough understanding of the present invention. It will be obvious, however, to one skilled in the art that the present invention may be practiced without these specific details. In other instances, well-known structures such as registers, processors, etc., are not shown in detail in order not to unnecessarily obscure the present invention.

OVERVIEW OF THE DISPLAY-DATA MEMORY ORGANIZATION OF THE PRESENT INVENTION AND COMPARISON WITH THE PRIOR ART

Figure 1B:
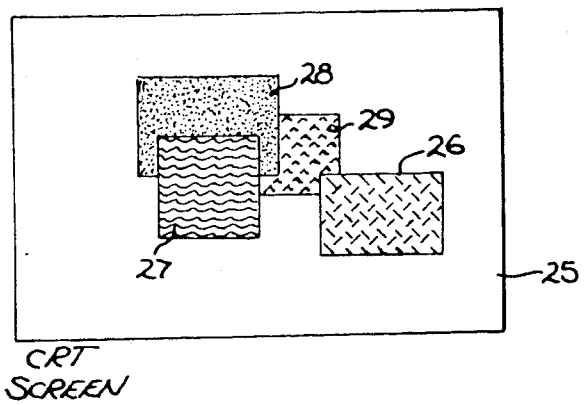
FIG. 1*b* illustrates a CRT screen displaying the objects of FIG. 1*a*.
Figure 1A:
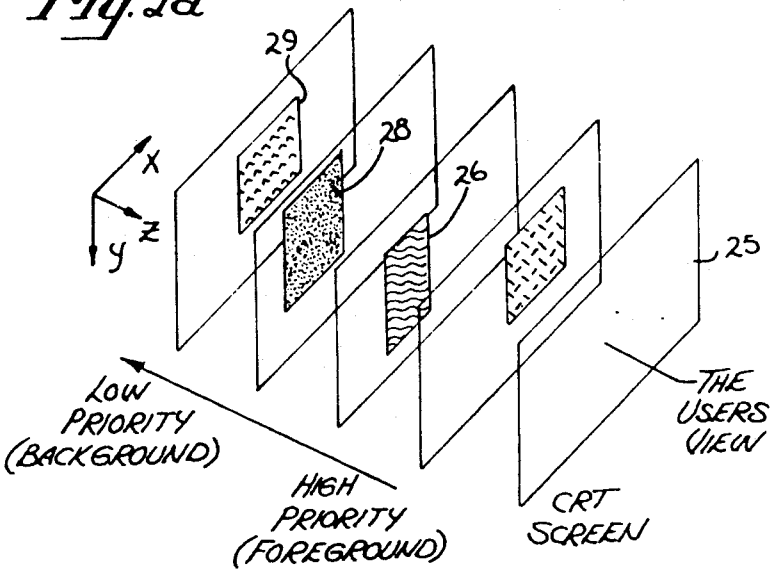
FIG. 1*a* is a perspective drawing showing several objects intended for display and their relative priority, that is, their position from background to foreground.

In FIG. 1*b*, a raster-scanned cathode ray tube display 25 is shown which comprises a plurality of objects or windows, specifically objects 26, 27, 28 and 29. Each object displays different data, for instance, text, color, etc. The display 25 with its overlapping windows is typical of displays, for instance, used in some personal computers such as the MACINTOSH computer from Apple Computer, Inc. The display 25, in effect, represents what a viewer would see if each of the objects are assigned a priority (from foreground to background) from the user's viewpoint. This is illustrated in FIG. 1*a* with the objects 26–29 shown on different planes spaced-apart in the z direction. The display 25 thus can be considered to be made up of a plurality of separate objects, each of which is assigned a priority in the z direction and each of which has an origin along the x and y axes. As will be seen, the present invention is particularly useful in providing a display such as display 25, in addition to other displays. In the following description, for purposes of convenience, the invented apparatus is described operating upon generally rectangular objects or windows. (The teachings of the present invention can be used to form polygons, for example, and as is well-known in the art, a plurality of these polygons can be used to form complex images.) The use of the described apparatus for forming complex displays is described in conjunction with subsequent figures, such as FIGS. 21*a*, 21*b*, 21*c* and 21*d*.

Frequently, frame buffers are used in prior art displays. The frame buffer stores the data which is to be displayed in a one-to-one "mapped" relationship with display position. Display data is stored for each pixel. The data is read from the frame buffer in rasters at a rate synchronized with the cathode ray tube's horizontal synchronization rate. By way of example, a frame buffer may contain 24 bits of storage for each pixel, allowing each of the colors red, green and blue to be represented by 8 bits.

Figure 2B:
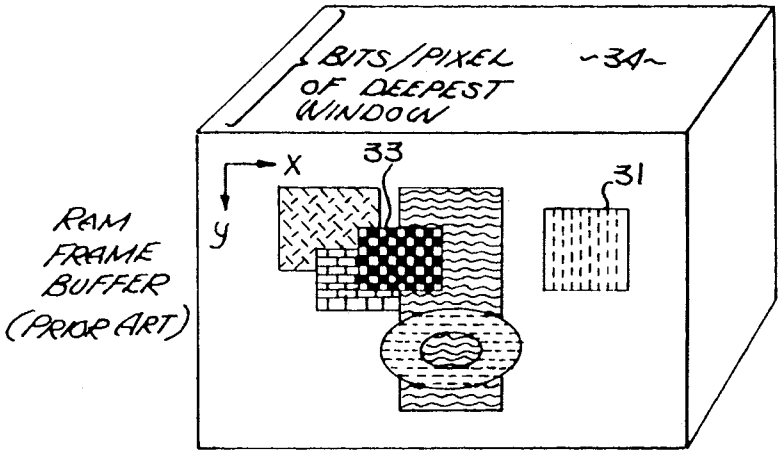
FIG. 2*b* is a diagram used to illustrate the manner in which the objects shown on the display of FIG. 2*a* are stored in a prior art frame buffer.
Figure 2A:
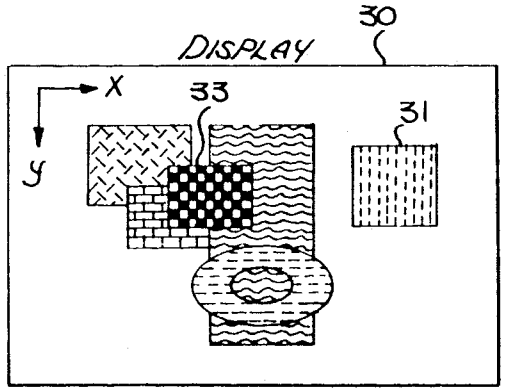
FIG. 2*a* illustrates several objects on a CRT display and is used in conjunction with FIGS. 2*b* and 2*c*.

A display 30 similar to display 25 of FIG. 1*b* is shown in FIG. 2*a*. A pictorial representation of the objects making up the display 30 are shown in a typical prior art frame buffer 34. The locations of the objects in the display can be seen having corresponding locations in the frame buffer such as shown for objects 31 and 33.

Most often, the frame buffer comprises a random access memory (RAM) which is accessible for each pixel of the display. The RAM provides storage for a predetermined number of bits for all pixels corresponding to the color depth (number of bits per pixel) of the deepest window in the display.

Referring to FIG. 2*c*, a RAM used with the present invention for storing display-data (object descriptions) is pictorially illustrated as RAM 35. The data for the objects in display 30 of FIG. 2*a* are stored within this RAM. Unlike the prior art frame buffer, the data for each object is stored in consecutive locations within the RAM 35. That is, by way of example, for object 33, the data is stored in contiguously accessible memory locations. This is in contrast to the buffer of FIG. 2*b* where the data for object 33 is stored in locations corresponding to the object's position on the display. Also, as can be seen for object 31, the data representing this object is stored in adjacent locations within the memory, and again, the storage locations do not resemble the x-y position of this object on the display.

The depth of the memory 35 is selected to be a convenient depth. For instance, where a 32-bit data bus is used within the apparatus, the memory can be 32 bits in depth. This, again, is in contrast to the memory of FIG. 2*b* where the depth of the memory is chosen to be equal to the number of bits used for each pixel. Importantly, with the present invention, the number of bits used to describe each pixel can be different for each pixel. That is, for a given object, by way of example, one bit can be used to describe some of the pixels in the object (e.g., black or white), while for other pixels, a multitude of bits can be used to define a complex color. The number of bits in a display-line (horizontal row of pixels) of a given object can also be different for each display-line of the object. Thus, for a given object, there can be a variation both in the number of bits used to define each pixel and the number of pixels used to define each display-line.

In addition to the display data shown within RAM 35, attributes for each object are stored in an object dispatch table. This table may be stored in a section of RAM 35 or in a separate memory. In the currently preferred embodiment the object dispatch table is stored within the RAM 35, however, it is moved to another memory within a functional block called the "dispatcher" (FIG. 11) for use. The attributes stored for each object are shown generally in FIG. 2*c* as: the object's position in the display (includes origin, object height, etc.); the object's priority, that is, the object's position in the z direction as shown in FIG. 1*a*; the location in the memory 35 where the object is stored; viewport clipping including viewport origin, viewport limit, etc. (this will be explained later); and, the first display list instruction which will also be explained later. By way of example, for a simple rectangular bit map, the attributes for an object would describe the size of the object, its position, the number of bits per pixel, and its first consecutive location in RAM 35.

FIG. 3 shows the RAM 35 having a configuration data section 36; an object dispatch table 37; and, the object description data such as shown in FIG. 2*c*. The configuration data section 36 contains information such as where to locate the object dispatch table, initialization data such as information on how the apparatus of the present information should interface with a CPU; etc. The object dispatch table, as mentioned, would indicate such items as where each object is stored within the memory 35. The arrows from the object dispatch table 37 of FIG. 3 thus point to the data for objects 40–44. As mentioned, the object dispatch table 37 is rewritten into a memory within the dispatcher. Addresses selecting the objects themselves from the RAM 35 are generated from the dispatcher. The table is moved to the dispatcher during the vertical blanking time.

Figure 4:
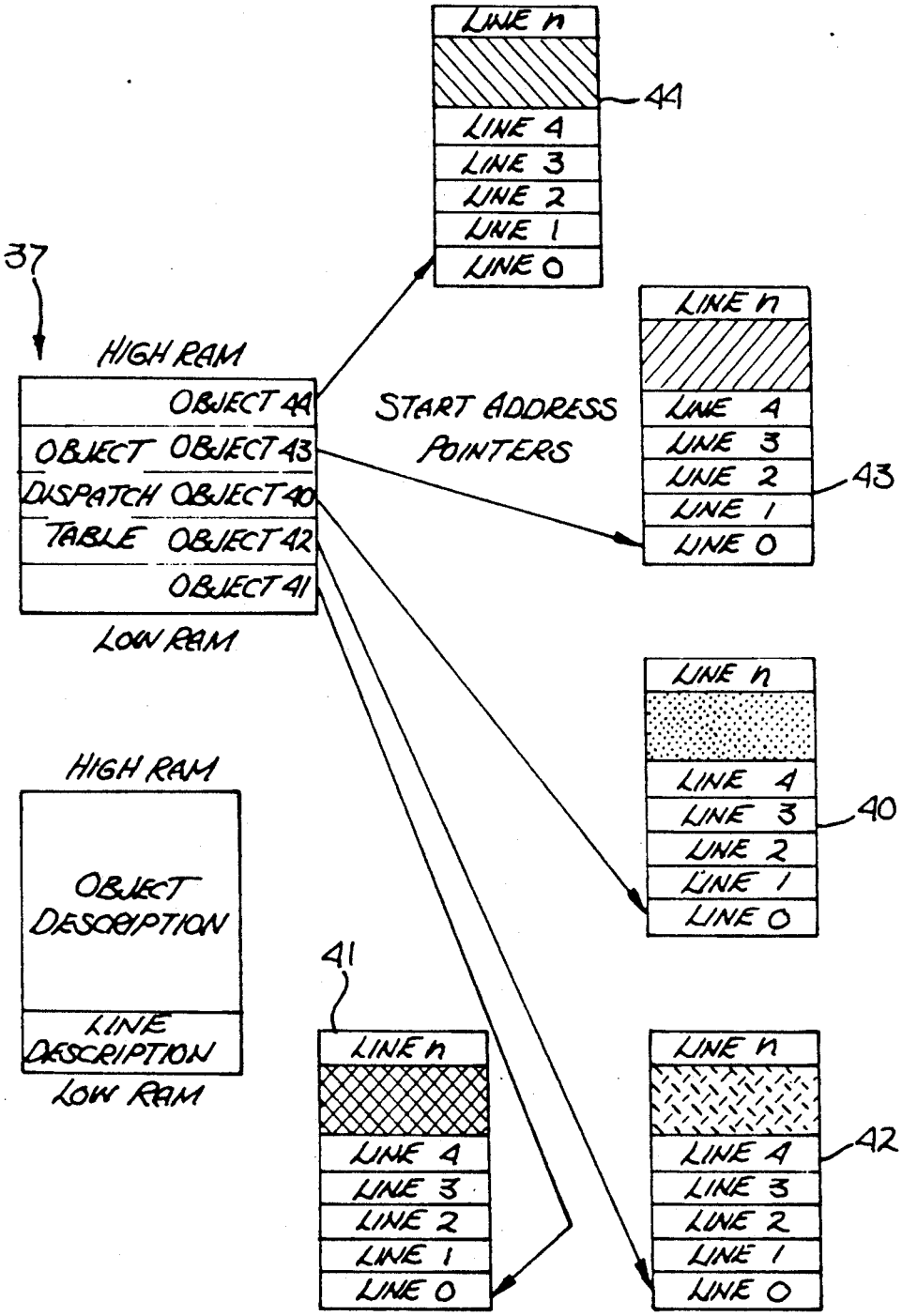
FIG. 4 is a diagram used to illustrate the relationship in memory between the object dispatch table and object data for the objects of FIG. 3.

The pointers from the object dispatch table to the object description data are illustrated in FIG. 4. The object dispatch table 37 is shown storing the attributes for objects 41–45. One attribute for each object is a starting address pointer which points to the first line of display-data within the RAM 35. The patterns for the objects 40–44 shown in FIG. 3 are duplicated within the blocks representing the data for each object of FIG. 4 to provide a correlation between FIGS. 3 and 4. It should be noted that the number of lines of RAM 35 used to store the data for each object will vary from object to object.

Figure 10:
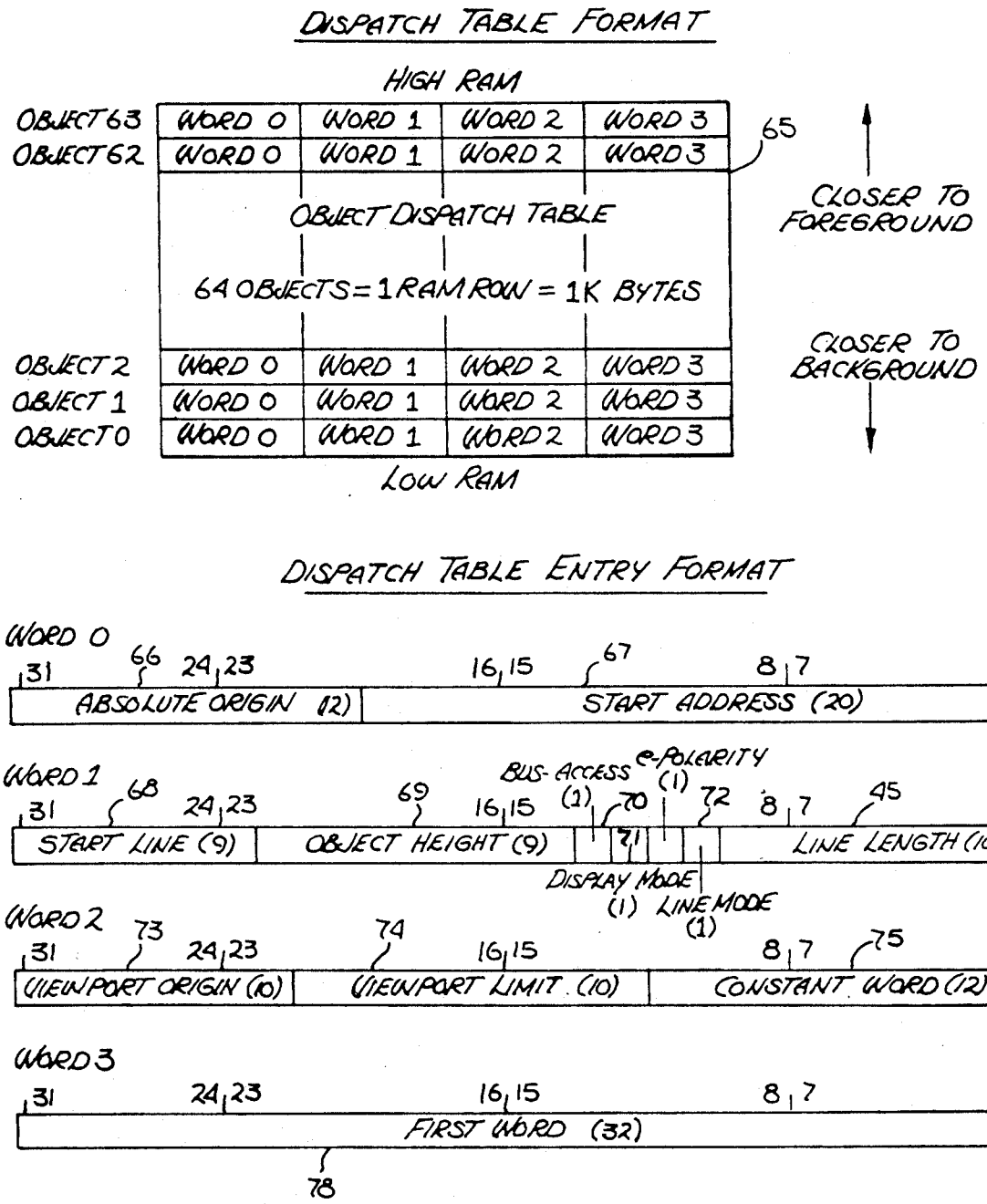
FIG. 10 illustrates the presently preferred dispatch table format.
Figure 22:
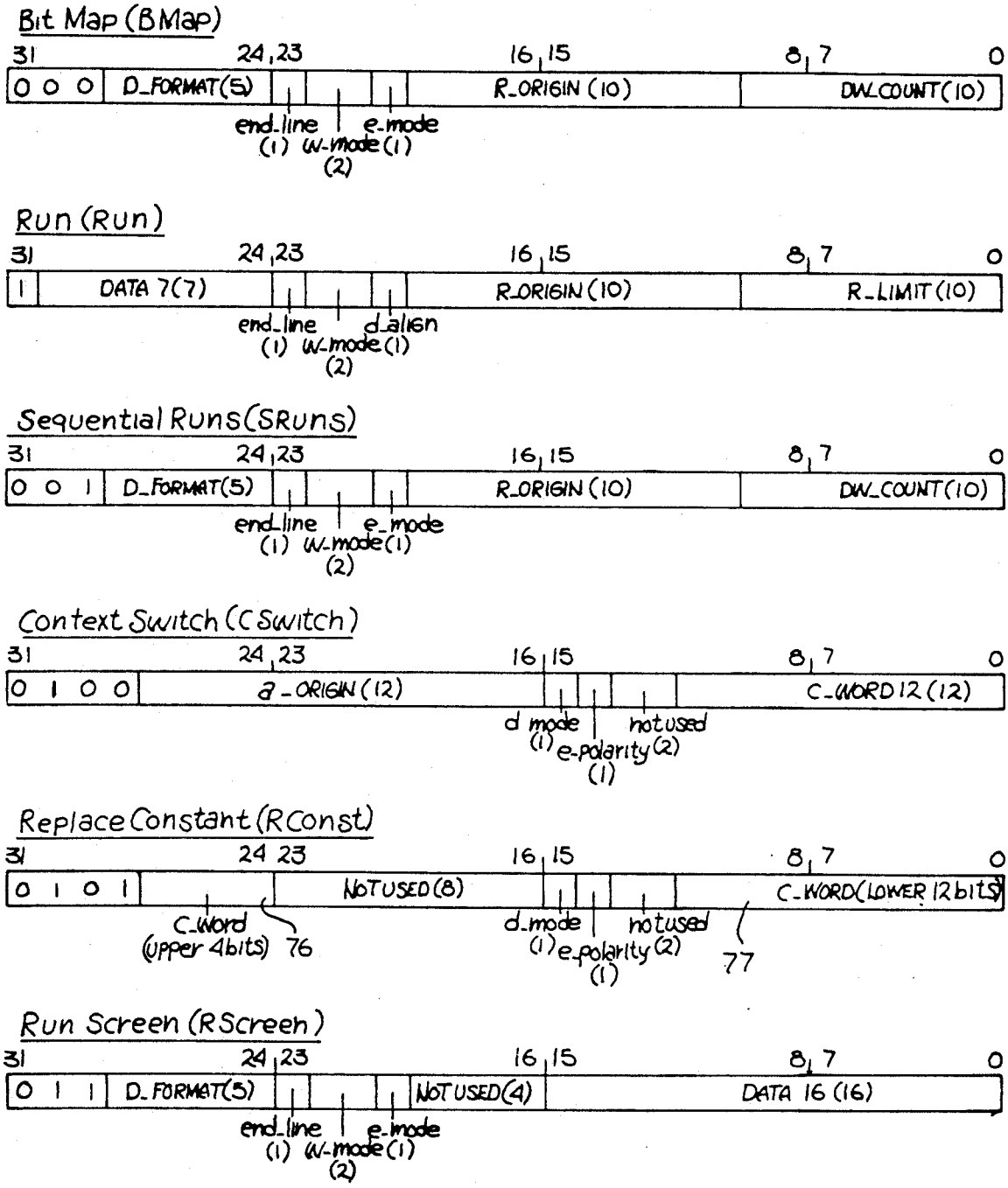
FIG. 22 is a diagram showing the currently preferred command word format.

In FIG. 4 each display line (line 0 to line n) is shown having the same width in memory. This is not necessary. Referring briefly to FIG. 10, the lower portion of the figure shows the dispatch table entry format. Field 45 is a 10-bit word indicating the line length. Where all the lines of a particular object have the same length, a counter is used to allow selection of a next line. Where each line has a different length in an object, command words stored within the display-data include an end-of-line signal in the command word format. Referring briefly to FIG. 22, the end-of-line command is bit 23 of the Bit Map (BMAP) command, bit 23 of the Run command, bit 23 of the Sequential Runs (SRUNS) command, and bit 23 of the Run Screen (RSCREEN) command.

OVERVIEW OF THE APPARATUS OF THE PRESENT INVENTION

The video display apparatus of the present invention provides video signals for a raster-scanned display. In the currently preferred embodiment, 8 bit digital signals for each of red, green and blue ("RGB") are provided as the video signals for a color monitor in one mode of operation. (As will be seen, in another mode, the line buffer provides a total of 16 bits of RGB data.) The display itself has 640 pixels in the horizontal direction and 480 pixels in the vertical direction. The non-interlaced frames occur at a rate of approximately 60 cycles. These specific numbers, however, are not critical to the present invention.

Figure 5:
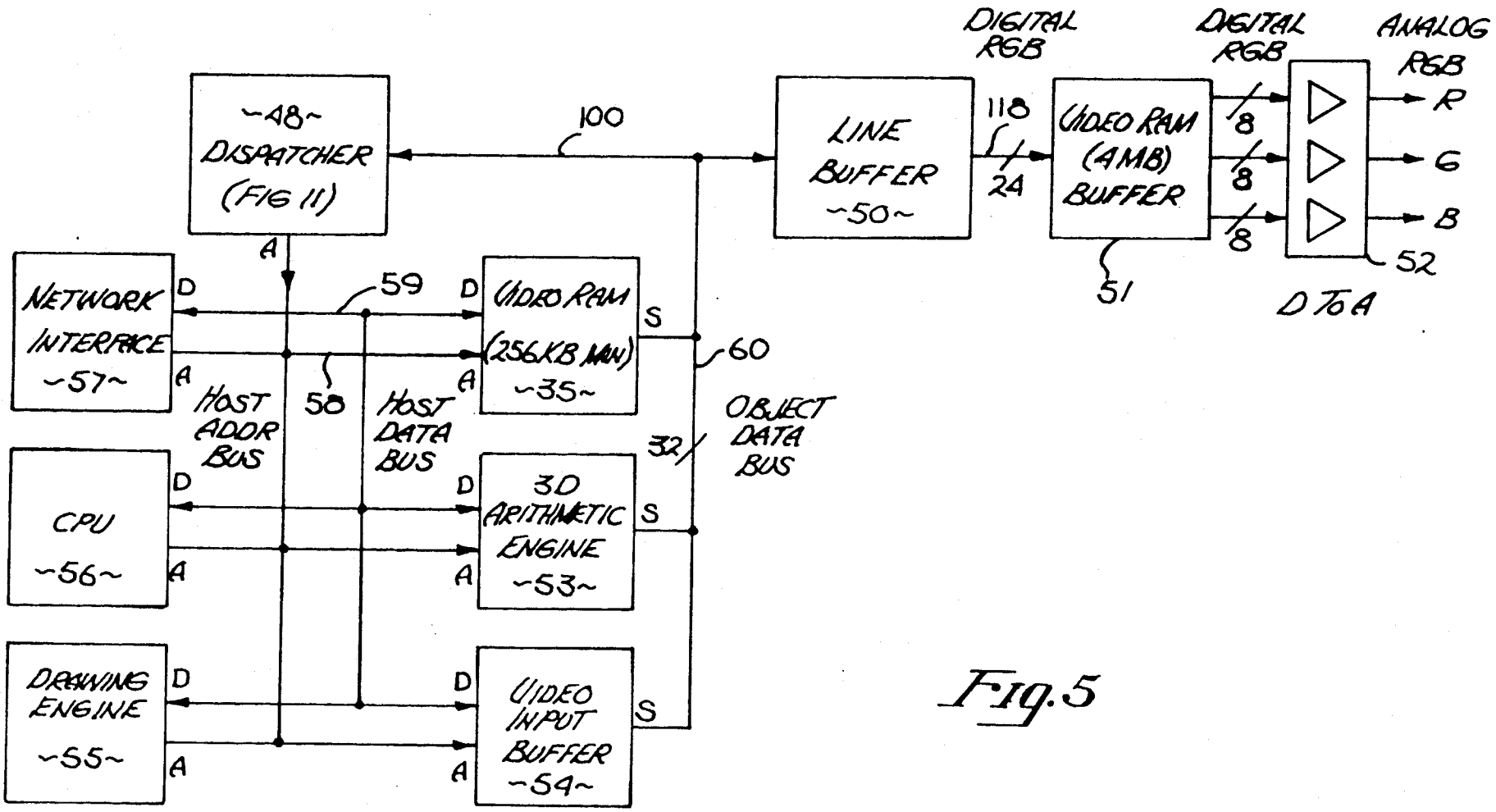
FIG. 5 is a block diagram of the apparatus of the present invention including an optional video RAM buffer.

The three major components of the apparatus as seen in FIG. 5 are the dispatcher 48, RAM 35 and line buffer 50. The dispatcher 48 and line buffer 50 are described in detail in conjunction with subsequent figures. In the presently preferred embodiment, each of these components would be realized as separate custom integrated circuits employing known technology, such as complementary metal-oxide-semiconductor technology. Video RAM 35 employs a plurality of commercially available dynamic random-access memories and is discussed below.

The display-data and the object dispatch table are written into the RAM 35 by any one of a plurality of known means. For instance, a commercially available central processing unit (CPU 56), a commercially available drawing engine 55, such as an NEC Part No. 7220. As illustrated in FIG. 5, a network interface circuit 57 may be used for receiving the display-data from a network and then transferring it into the video RAM 35. The network interface circuit 57, CPU 56 and drawing engine 55 are shown as several ways of providing the video data for the RAM 35; it will be obvious to one skilled in the art that other means may be employed to provide the display-data and dispatch table in the format described in the application. In general, these means provide the data to the video RAM by addressing the RAM on bus 58 and providing the data on bus 59. The dispatcher 48 also provides addresses on the bus 58.

The video input buffer 54 and 3D arithmetic engine 53 are not required for the present invention, but are examples of functional units which may bypass the RAM 35 to directly load dynamic object display-data into the line buffer 50, as described below. In this way, rapidly changing objects need not be reloaded into RAM 35 each time they change. The object descriptions in such functional units as these are mapped in the same address space as the object descriptions in RAM 35. A video input buffer 54 which can serve as a "frame grabber" for receiving frames from, for instance, a video camera, can be used to provide the data in conjunction with that in video RAM 35. A 3D arithmetic engine 53 is a functional unit to compute the object description of 3-dimensional models and can be constructed using commercially available parts such as those from Weitek.

The video RAM buffer 51 is not required for the present invention. There are certain applications in which it may be used since it allows the storage of an entire frame of data. As will be seen, the line buffer 50 generates one line of data at a time and therefore must operate at a speed consistent with the horizontal synchronization clock. When used, the buffer 51 is organized like a typical prior art frame buffer, such as that described in conjunction with FIG. 2*b*.

In general, for each frame of the display, the dispatch table is first transferred to the dispatcher 48. The dispatcher then begins to access the display-data for each of the objects on a line-by-line basis. That is, by way of example, starting with line 0 of the display, the dispatcher determines which objects have data for line 0 and then accesses this data from the RAM 35 or functional units 53 or 54 by coupling addresses over the bus 58. If an address maps within the address space of the RAM 35, then the data will be read from the RAM 35 and coupled to the bus 60 to the line buffer 50. If an address maps within the address space of a functional unit 53 or 54, then the unit will couple the data of the object identified by the address to the bus 60 through to the line buffer. The line buffer 50 composes line 0 from the data it receives for the various objects which extend to line 0. The object's priority (z direction position as shown in FIG. 1*a*) determines the order in which the data for each object is read from the RAM 35 and the functional units 53 and 54. Commands are embedded within the data read from RAM 35 and the functional units 53 and 54. These commands, as will be seen, are interpreted both by the dispatcher 48 and buffer 50. Thus, both the dispatcher and line buffer operate in a manner similar to a distributed processor in the preparation of each line of video data. The line buffer 50 performs numerous functions such as the comparison of address signals received from the dispatcher, as will be described. In the preferred embodiment, line buffer 50 provides "double buffering", that is, while one line of video data is being composed in one section of the buffer, a line of video data which has previously been composed in another section of the buffer is read for display. After each line of video data is composed in the buffer 50, it is then transferred to the D-A converters 52 to provide the RGB signals for a monitor. If the RAM 51 is used, then video data is transferred first to the RAM 51, then it is scanned out from the RAM 51 to the D-A converters 52 to provide RGB signals for a monitor.

VIDEO RAM

In the presently preferred embodiment, the RAM 35 comprises a plurality of commercially available dynamic random-access memories referred to in the trade as "video RAMs". These RAMs have two ports, one a serial port, the other, an ordinary random-access port. The data can be written into and read from the random-access port which is coupled to bus 59. Data is read from the serial port which is connected to bus 60 of FIG. 5. In effect, internal to each of the DRAMs, the data is moved from the internal RAM array into a shift register and then read out serially from the shift register. Although the shift register is loaded in alignment with the rows of the internal RAM array, the data may be shifted out from the shift register starting at any location in the register. The reading of the data from the shift register can be done asynchronously with other memory operations. A typical example of a video RAM is Part No. 41264, available from NEC Electronics, Inc. The memory has an access time of 120 nsec. for the RAM port and 30 nsec. for the serial port. In the currently preferred embodiment, the RAM 35 employs these DRAM "chips" to form a memory having a capacity of at least 256K bytes, but preferably 1M bytes. The serial ports are coupled to the 32 lines of bus 60 such that for each input address applied to the DRAMs to load the shift register and select a shift start address, up to 256 serial output words of 32 bits each are coupled onto bus 60, read out by a single clocking signal. In other words, after an initial address, loading the shift register with a row and identifying a shift register start location, data may be read out from the shift register by means of a single clocking signal.

OVERALL FLOW OF CONTROL

Assume that the apparatus of FIG. 5 is commencing to compose a particular raster line of the display. The following is a summary description of the flow of control which occurs during this composition.

The dispatcher 48 determines which objects intersect the current raster line and among those objects which one is the furthest in the background. Having made this determination, the dispatcher accesses the attribute data for that object, previously loaded into the dispatcher from RAM 35 during the vertical blanking time. The dispatcher then takes control of address bus 58 and couples an address on that bus which is the first address of the data for that line (which coincides with the current raster line of the display) of the object. One of the functional units of FIG. 5 or RAM 35 is responsive to the address on bus 58. The addressed data is thereby located and it is prepared for transmission on bus 60. In the case of the video RAM 35, the address indicates which row is to be transferred to the video RAM shift register, and from where in the register the shifting is to begin.

Simultaneous to the address generation on bus 58, the dispatcher couples a sequence of instructions (see FIGS. 22 and 23) which prepares the line buffer for the data about to be sent by the device responsive to the dispatcher's address. (Notice that these instructions are identical to instructions contained in object descriptions as stored in RAM 35 or generated by the functional units 53 and 54; the line buffer simply receives a stream of instructions and acts on them without knowing their source.) This sequence of instructions from the dispatcher specifically: (1) Prepares the content of the line buffer for the particular object including establishing an absolute origin (a horizontal reference point from which horizontal positioning information for the object is offset), a constant word (filler bits for data not provided by the write data of the object description, e.g., 15 bits for one bit per pixel bit maps to make up a full 16-bit word), and certain mode information. (2) Clears the mask bit across the line buffer (thereby preventing any writes to line buffer cells). (3) Sets the mask bit across a continguous portion of the line buffer (overriding the clearing operation just performed) corresponding to the desired horizontal visible extent of the object on that line, called its horizontal viewport (for example, even if the object line description loaded into the line buffer extends beyond this veiwport to the left or right, only the portion of the line buffer within this viewport will be altered, and thus, in only that viewport will the object be visible on display). (4) Provide the first word of the first instruction for that line (for example, if the object is a rectangular bit map, this first word would be a Bit Map instruction as shown in FIG. 22).

After the addressing operation on bus 58 has completed and the instruction sequence has completed loading from the dispatcher into the line buffer, the dispatcher relinquishes control of bus 58 and commences to clock (on a single signal line not shown) the RAM 35 or functional unit which has been addressed with the address of the start of the object data for that line. This data may complete an instruction started by the first word just sent by the dispatcher (as would be the case if the first word was a Bit Map or Sequential Runs instruction) or may begin an instruction anew (as would be the case if the first word was a Run instruction). Once the first instruction of the line has completed loading, the subsequent data may then contain additional instructions for the line, for example, when loading a complex sequence of Runs to describe the faces of a 3D polyhedral object.

The dispatcher determines when the end of the line of data for the object has been reached by one of two means: if the object has fixed-length lines, by determining that the length has been exhausted, and if the object has variable-length lines, by detecting an end-line bit (see bit 23 of the Bit Map instruction of FIG. 22, for example) on the last instruction of that line of the object. At this point, the dispatcher discontinues clocking RAM 35 or functional unit providing the data, and determines whether another object appears on that line. If one does, the dispatcher takes the next object toward the foreground after the object just loaded and commences a loading operation for this object in a manner exactly as described for the previous object above. (Notice that where this object coincides with the previous object in the line, it will overwrite in the line buffer, giving the appearance of being in front of the previous object.) If there are no more objects appearing on that line, the dispatcher will wait until the next horizontal blanking interval to commence composing the next raster-line of the display into the line buffer in exactly the same way as it composed the current line.

There is, however, an exceptional case where an object's line description is contained in RAM 35 and crosses a row boundary. In this case, the shift register in RAM 35 will be exhausted before the object's line description data has completed loading so the dispatcher will take control of the address bus 58 at this time and reload the shift register with the contents of the subsequent row of RAM 35. In general, this reload operation can be anticipated and synchronized with the shifting out of data so that the shift register is reloading between the last clock of the end of the first loaded shift register and the first clock in the beginning of the reloaded shift register so that data clocking is uninterrupted.

In the currently preferred embodiment, two line buffers are used so that one may be loaded, as just described, while the other is scanned-out to the display, then upon the next horizontal blanking interval, the roles are reversed. Thus, a line is composed exactly one line time before it is displayed.

Notice that if it takes more time to load all of the line descriptions of all of the objects intersecting a raster-line than can be loaded in one horizontal line time of the display, then the composition of the line will not be complete in time for when the line is needed to be scanned-out. This is a fundamental limitation of the configuration where the line buffer 50 is directly connected to the digital-to-analog converters 52 and can be solved by placing RAM 51 in between (as shown in FIG. 5.) RAM 51 is a double-buffered memory array capable of storing and scanning-out two full frames of video at the deepest color depth that can be generated by the line buffer (16 bits per pixel in the currently preferred embodiment). With this added RAM 51, the rest of the apparatus can take as long as each line needs for composition before it is transferred into one of the frame buffers since one frame buffer will refresh the screen with a stable image while the other frame is being slowly composed line by line. When this frame's composition is completed, the apparatus waits for vertical blanking and switches the roles of the frame buffers and commences to compose the next frame while the one it just completed is displayed. In this way, an arbitrary amount of composition complexity can be realized.

DISPATCH TABLE FORMAT

In the current implementation, the object dispatch table (sometimes referred to as "ODT") is configured for 64 objects as shown in table 65 of FIG. 10. The object's priority (z position) is not directly stored, but rather is implied from the location at which the object's attributes are stored. More specifically, object 63 has the highest priority, that is, it is closest to the foreground and it is stored in the first location (highest address assigned to the dispatch table). The attributes for each object comprise four 32-bit words (Word 0-Word 3) with the specific contents of each word shown in FIG. 10 under the heading of "Dispatch Table Entry format". Therefore, the entire dispatch table consists of 1K bytes or with the preferred layout for the RAM 35, one row of RAM. This way only a single video RAM serial port load operation is necessary for reading the RAM 35 when the table is being transferred into the dispatcher.

Word 0 for each of the objects includes a 12-bit field 66 which provides the absolute origin of the object in the horizontal direction of the display. This field is large enough to permit the origin to be located to the left or right of the display which, as will be seen later, is useful. The 20-bit field 67 of Word 0 provides the start address in the RAM 35. This is the address shown as "start address pointers" of line 0 in FIG. 4.

The 9-bit field 68 of Word 1 indicates the line from the top of the display at which the object begins. The 9-bit field 69 provides the object height on the display. The bit 70 of Word 1 is a memory control bit for accessing the RAM 35. The bit 71 indicates the display mode, specifically, whether the object description data from the RAM 35 represents RGB signals or is rather a pointer to a color lookup table (shown as X, L in the line buffer figures). The bit 72 indicates whether the line length is variable or fixed and, as previously mentioned, the line length itself is contained in the 10-bit field 45 if the line length is fixed.

The 10-bit field 73 of Word 2 provides the viewport origin (leftmost origin) and the 10-bit field 74 the viewport limit (rightmost extend of viewport). The viewport will be described in more detail later. The 12-bit field 75 provides a constant word which is used in connection with certain commands for "filling in" locations of the buffer. Where a 16-bit constant word is required, a specific command is used, identified in FIG. 22 as "Replace Constant command". The upper four bits and lower twelve bits of the "C word" are shown as fields 76 and 77, respectively, in FIG. 22.

Word 3 is a 32-bit field 78 which is the first word for the first line of the object. More specifically, this field will be a command, such as "Bit Map" or "Run" as shown in FIG. 22.

DISPATCHER

Figure 11:
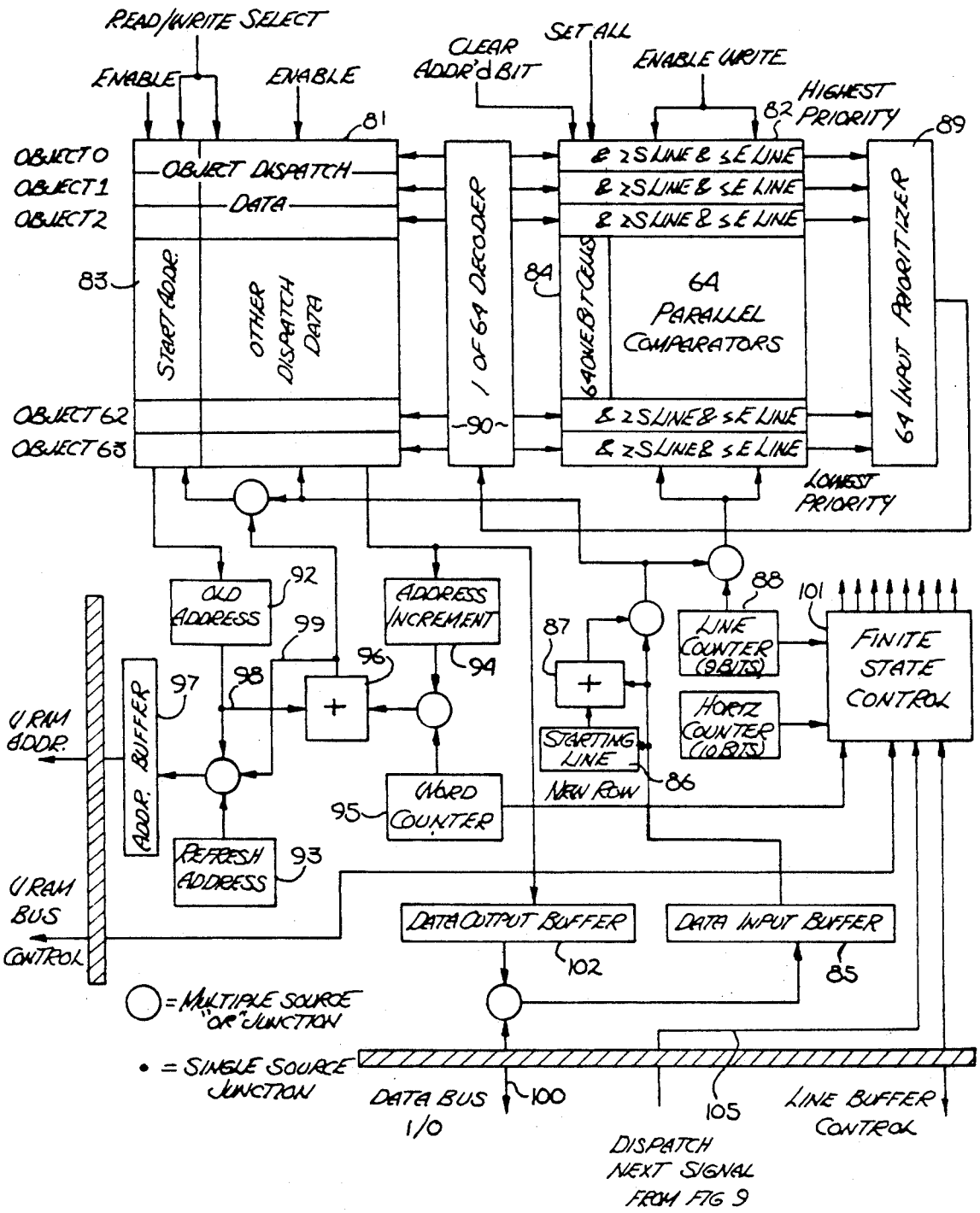
FIG. 11 is a block diagram of the dispatcher.

Referring to FIG. 11, the dispatch table, when transferred to the dispatcher, is stored in a different format in the dispatcher to enable more rapid processing. The memory 81 stores the starting address for each object in a section 83. The remaining attributes except for the start line and object height are stored within the memory 81 in the area indicated as "Other Dispatch Data".

The circuit 82 includes 64 parallel comparators, one for each object. Each comparator performs the function of comparing the current line (from line counter 88) with both the start line (S line) for the object and the end line (E line) for the object. There is a one bit cell associated with each object included within the section 84 of circuit 82. For each object, circuit 82 ANDs the content of this cell with the results of the comparison. Specifically, the following occurs: "Cell Content" $<\underline{S}$ line $>\underline{E}$ line. Thus, for instance, for object 0, if the cell 84 is set to 1, and the start line is 10 and the end line is 20, a 1 output occurs when the line counter 88 is between 10 and 20. This output is one of the 64 inputs to the prioritizer 89.

When the dispatch table is transferred to the dispatcher from the RAM 35, the data is passed through the buffer 85 and loaded into the memory 81. The start line is loaded into circuit 82. The start line for each object is also loaded into the register 86 and added to the object's height in adder 87 to provide an end line (E line) which is stored within the circuit 82. Note that if desired, the end line itself could be an attribute stored within the RAM 35 and directly loaded into circuit 82.

The functioning of the circuit 82, prioritizer 89 and decoder 90 will be better understood if their purpose is first appreciated. Typically, an object does not cover the entire display (from top to bottom). Considerable time would be wasted if the dispatcher of FIG. 11 were required to operate on objects for those lines where the object is not present. Again, by way of example, assume object 0 is present between display lines 10 and 20, time would be wasted if the object's attributes were examined for lines 0–9 and for lines 11 on. The 64 parallel comparators 82 each provide a signal to the prioritizer 89 only when the object is present on the current display line of counter 88. This enables the unncessary consideration of objects for those lines where the object is not present.

At the beginning of each display line, all 64 bits of the cells 84 are set to 1. Then the comparison occurs in parallel for all 64 objects which determines whether the object is present for the line under consideration. If the object is present for the line, as mentioned, an output signal is presented to the prioritizer 89. The prioritizer 89 examines the outputs from the circuit 82 and provides a signal to the decoder 90 indicating the highest priority number present. The decoder 90 then selects this object from the memory 81. After this selection occurs, the decoder sets the bit in section 84 for this object to 0. This prevents the object from again being selected for a particular display line since the comparator output for that object drops to zero. The prioritizer then selects the next highest priority object until all objects that are present for a given line are considered. At the beginning of the next display line, the bits again are set to 1 in section 84. In this manner, only the objects that should be considered for a given line are considered and the objects are considered in the order of their highest priority.

The register 92 (20-bit register), address incrementer 94, word counter 95 and adder 96 provide addresses to the RAM 35 through the address buffer 97. As each object is selected by the decoder 90, its starting address is coupled to the register 92 and to the RAM 35 through the buffer 97 to select the first word of data for the line. If the word length for the object is fixed (bit 72 of FIG. 10), the increment needed to select the first word of data for the next line is coupled through the address incrementer 94 and adder 96 and added to the address in register 92. The new address is then returned to section 83 of memory 81 and is used for the next line. If, on the other hand, the data per line is not fixed, its length is determined by field 45 of FIG. 10. Word counter 95 counts the length of the line as the words are read out of RAM 35. During this mode, the old address is added (line 98) to the output of the counter 95, once the line of the object has completed loading, in adder 96. Again, the new starting address for the next line is the result of this addition and is stored in section 83 of memory 81. Note that the word counter 95 is required for both fixed of variable length objects since the data required for a line of an object may cross the row boundaries of data from the RAM 35, requiring the video RAM shift register of RAM 35 to be reloaded. The counter 95 therefore also couples a signal to the finite state controller 101, allowing this controller to cause the RAM 35 to reload the shift registers, with the next row in the RAM using the address determined by the sum of the word counter 95 and the old address stored in the register 92 computed through adder 96, coupled through line 99 to buffer 97. Refresh addresses are provided by circuit 93 to control the refreshing of the dynamic RAM of RAM 35.

Data from the memory 81, such as the absolute origin, is coupled for each object through buffer 102 into the line buffer via the data bus 100.

The finite state controller 101 controls the operation of the dispatcher and its timing. It receives a signal on line 105 from the circuit 104 of FIG. 9. This signal informs the dispatcher that the last instruction (end line bit) has been received and that the data for the next object should be sent. This is also used for the variable length line mode to establish when a line of the object data has completed loading.

LINE BUFFER

Figure 6:
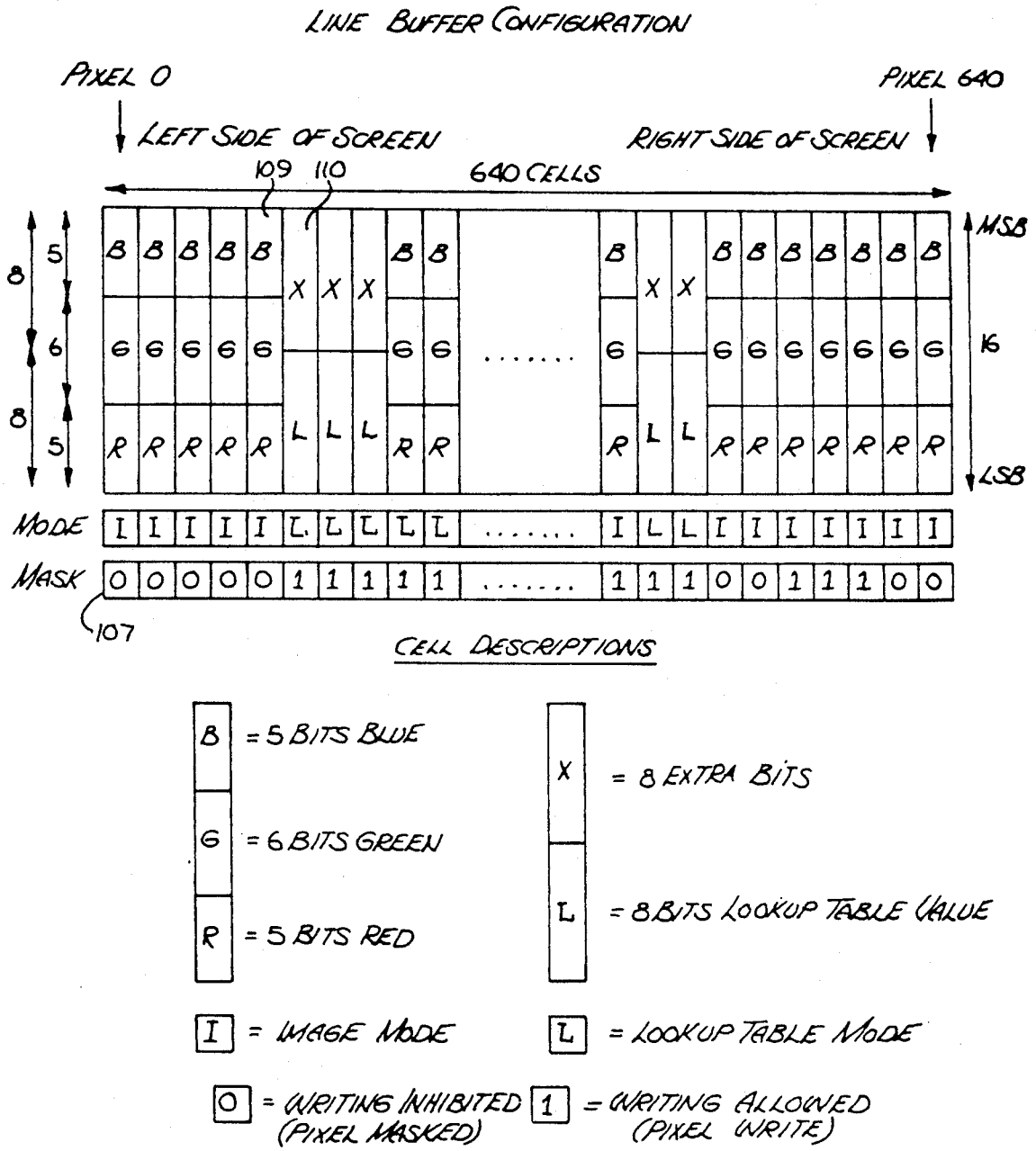
FIG. 6 is a diagram illustrating the line buffer configuration and typical cell contents.

First, referring to FIG. 6, the line buffer has 640 cells, one for each pixel along a display line. (Only a single line buffer is shown in FIG. 6, however, it should be recalled that there are two line buffers to permit double buffering in the currently preferred embodiment, and the second line buffer is shown, for example, in FIG. 7.) Each cell includes storage for 16 bits (designated RGB or X,L), a mode bit and a masking bit. In the currently preferred embodiment, the RGB data is divided into 5 bits for red, 6 bits for green and 5 bits for blue. If RGB data is stored within the cell, then a binary one is stored for the mode bit (image mode). In FIG. 6, this bit has been shown as either I or L for purposes of explanation. The 16 bits can alternatively be used to store data which can be used as a pointer to a lookup table. This is the "L" (color lookup table or CLUT) mode. The 16 bits are divided, in the currently preferred embodiment, into 8 bits for a lookup table and 8 extra bits which, for example, can be used to select a particular lookup table. In the L mode, the RGB colors are selected from the lookup table. In this case, RGB can be 8 bits each as shown coupled to the D-A converters 52 of FIG. 5. The masking bit shown along row 107 prevents or permits writing into a particular cell. The use of this bit will be described later. Importantly, it should be noted that for any given line, RGB data can be mixed with X,L data. Thus, as shown in FIG. 6, cell 109 (pixel 4) may have RGB data which is directly converted by the D-A converters for the monitor, while the content of cell 110 (pixel 5) can be an address to a CLUT. This flexibility permits the selection of colors which would not otherwise be obtainable from the 16-bit field.

Figure 7:
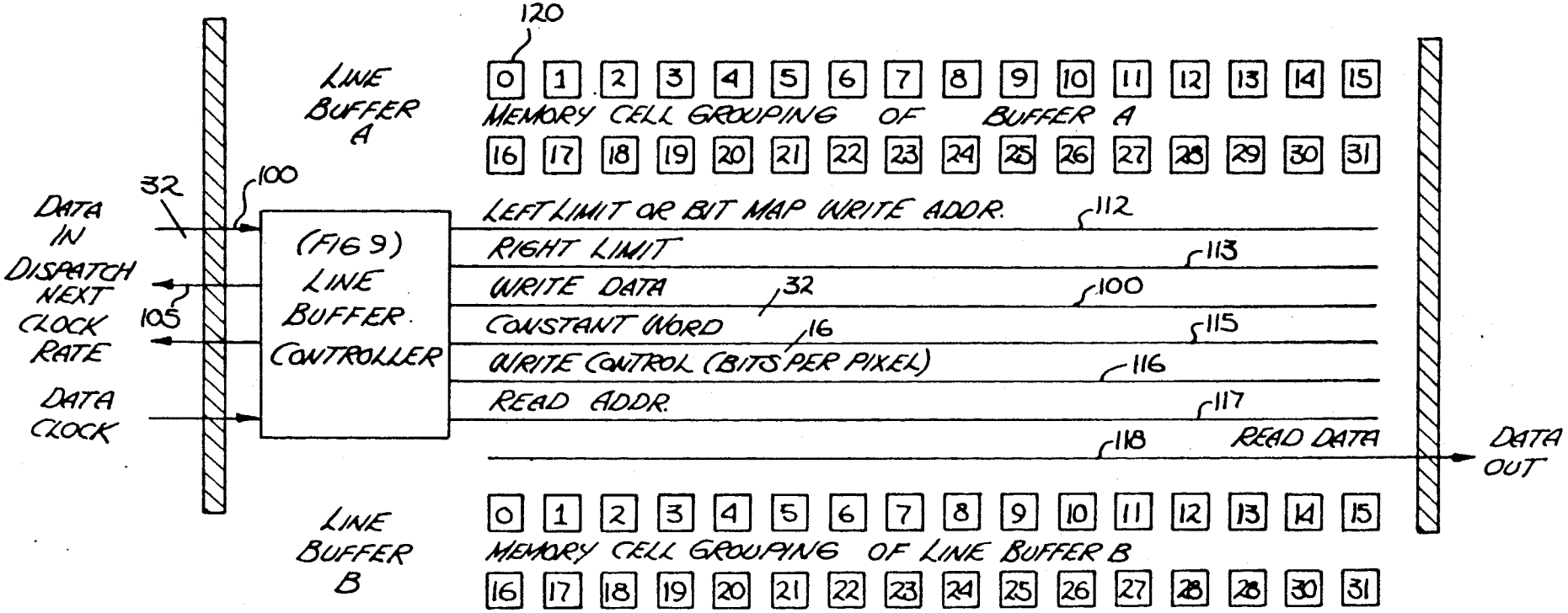
FIG. 7 is a diagram illustrating the cell architecture in the line buffer.
Figure 8:
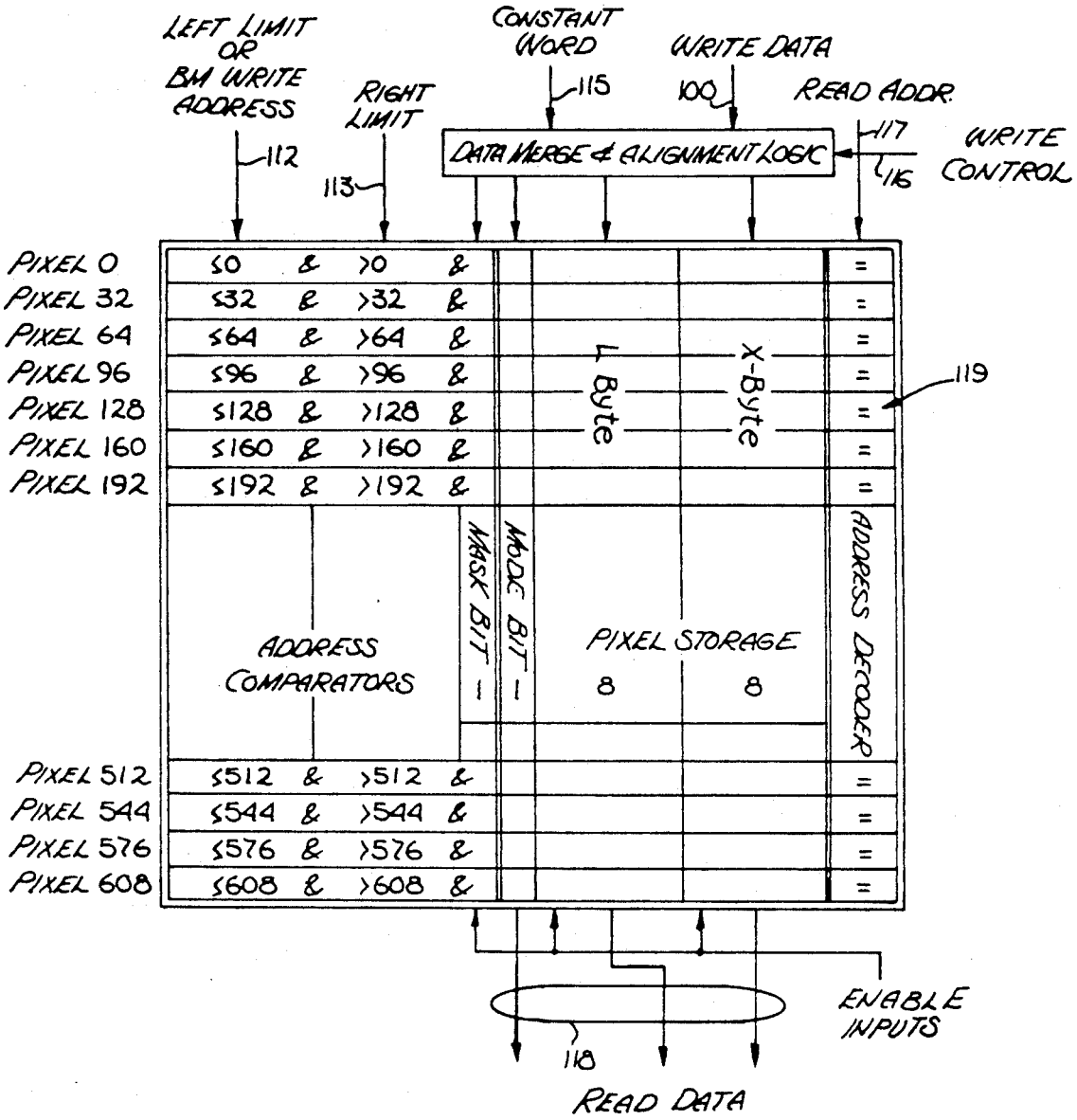
FIG. 8 is a diagram illustrating the layout of an individual cell, and in particular, for memory cell group zero.

The memory cells for each pixel are grouped in an unusual manner, and as will be seen, this provides an important advantage. In FIG. 7, line buffer A and line buffer B are both shown having 32 memory cell groups. Each memory cell group includes 20 cells. Examining cell group 0 (shown within rectangle 120 of FIG. 7), this group stores pixel data for pixel 0, 32, 64, 96 . . . through pixel 608 as shown in FIG. 8. Memory cell group 1 stores the pixel data for pixels 1, 33, 65, 97 . . . through pixel 609. And finally, memory cell group 31 stores the pixel data for pixels 31, 63, 95, 127 . . . through pixel 639.

Figure 9:
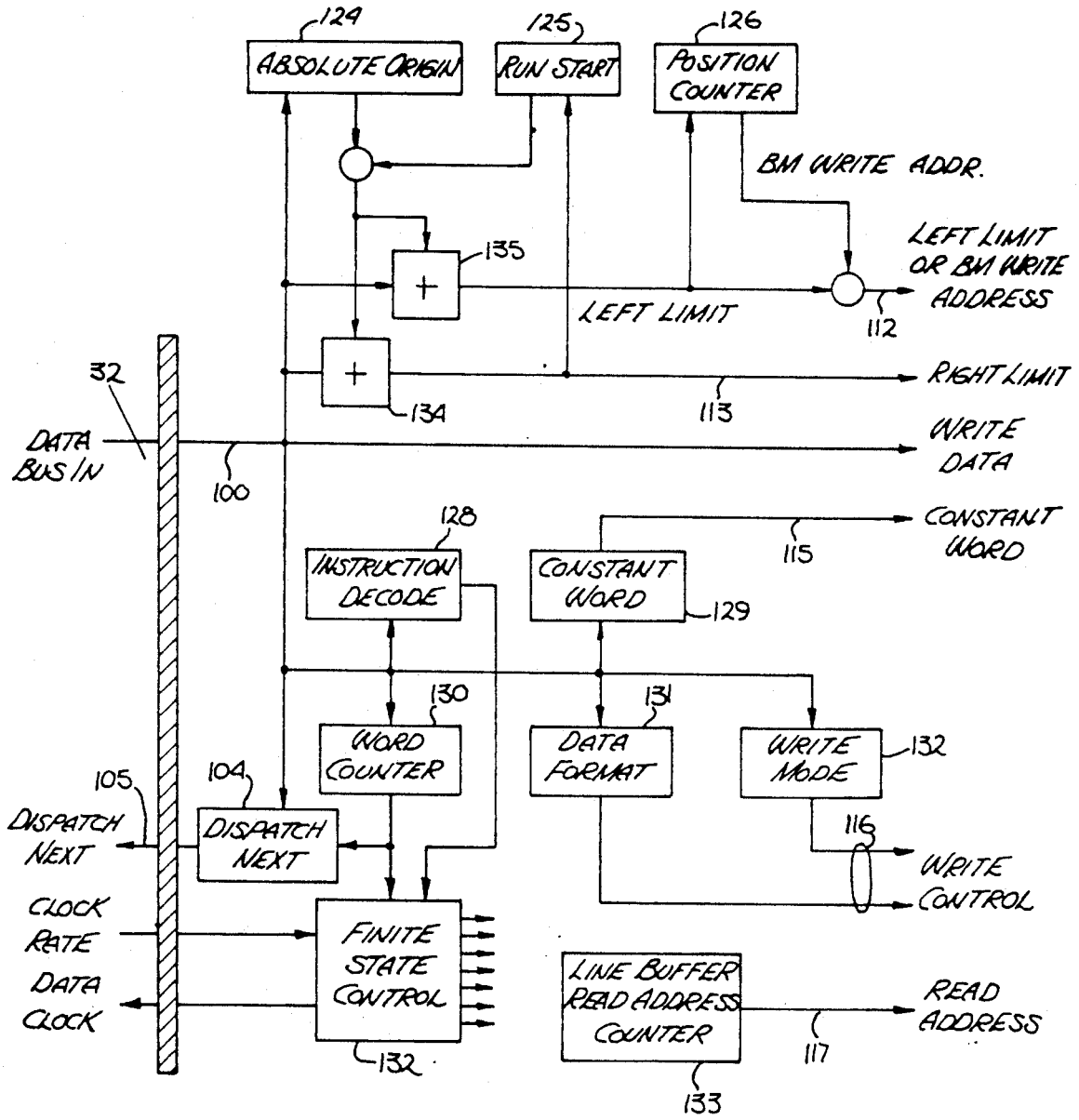
FIG. 9 is a block diagram of the line buffer controller.

Referring to FIG. 7, each group of memory cells is coupled to a left limit or bit map write address bus 112, right limit bus 113, write data bus 100, constant word bus 115, write control bus 116, read address bus 117, and read data bus 118. The signals on these buses are received from the line buffer controller which is shown in FIG. 9, the dispatcher, and the RAM 35.

Referring now to FIG. 8, each group of memory cells, as mentioned, includes 20 cells, that is, storage for 20 pixels. Each cell such as cell 119, includes the display-data storages (RGB or X,L), mode bit storage and masking bit storage, as previously discussed in conjunction with FIG. 6. Additionally, each cell includes an address decoder. This address decoder receives the read address signals on bus 117 and allows the data in the cells to be read onto bus 118 (i.e., RGB (or X,L), and mode bit). This is done after a line has been composed in the buffer and is read from the buffer for display. Additionally, each cell includes computational means, specifically logic circuits which permit comparisons to be made between the cell's pixel number and the left limit (or bit map write address) on bus 112 and the right limit on bus 113. By way of example, for cell 119, which stores data for pixel 128, this cell includes logic which compares the limit/address on bus 112 to determine if this limit/address is less than or equal to 128. The comparator also determines whether the limit on bus 113 is greater than 128. If the limit/address on 112 is less than or equal to 128, the limit on bus 113 is greater than 128, and a 1 is in the masking bit cell, cell 119 will accept data from the data merger and alignment logic circuit 121.

The data merger and alignment logic circuit 121 receives the constant word from bus 115 and the data from bus 100 and under the control of the write control signals on bus 116, merges and aligns these signals so that they are coupled into the appropriate locations within the cell or cells which are being addressed. A few examples which follow in this application will make clear the purpose of the circuit 121.

The data from circuit 121 can be simultaneously written into one or more cells in a cell group. In fact, the data from circuit 121 (and like circuits associated with other cell groups) can be written into all the cells of all the groups simultaneously.

First, consider a case where the display requires just a single bit per pixel (a 1 or 0). The pixel storage field for each cell is 16 bits as shown. Assume further that 15 bits of the 16 bits are to be filled in with all zeroes. A 32-bit word containing the ones and zeroes of the bit pattern to be displayed can be coupled onto the write data bus 100. The left and right limits on buses 112 and 113 can be adjusted so that the cells for pixels 0–32 accept the data from the bus 100. (Note this is possible because of the grouping described in connection with FIG. 7. The cells for pixels 0–32 are each located in a different group of cells and, consequently, the 32 bits on the bus 100 can be distributed into the 32 cells.) The remaining 15 bits which are to be all zeroes can be coupled to bus 115 and written in the appropriate cells at the same time the data is accepted from bus 100. The control signals on bus 116 allow the constant word to be lined up with the appropriate lines for coupling to the cells. The above simple example illustrates the advantage of the grouping of cells, constant word and left and right limits.

Consider an example where the entire display is to be one color, definable by RGB signals. The left and right limits on buses 112 and 113 can be set so all the cells accept data from their respective data merger and alignment logic circuits 121. A single word on the write data bus 100 can therefore be written into all 640 cells.

Other advantages to the buffer will be described in connection with specific displays later in this application.

COMMAND WORDS

It will be helpful to understand the command word format before examining the controller of FIG. 9. Referring to FIG. 22, six command words are illustrated.

The first field of each of the words is used to identify the command. For instance, 000 identifies Bit Map (BMAP), 1 identifies Run, 001 Sequential Runs (SRUNS), etc. This field is coupled to the instruction decoder 128 of FIG. 9.

The second field of the Bit Map command identifies the data format being used and ultimately provides the write control signals. This is coupled to the data format register 131 of FIG. 9. The two bit field "W mode" is coupled to the write mode register 132 and identifies the writing mode to be employed. The next bit "E mode" determines whether an embedded mask is to be used; this is explained later. The next 10 bit field "R origin" is the relative origin of the bit mapped object (as opposed to its absolute origin), both of which are explained later. The final 10 bit field provides a count of data words for the bit map and is coupled to the counter 130 of FIG. 9. In the case of this command and other commands, specific examples will be given later in the application.

The Run command permits a single run, that is, a particular data word to be written to all cells in the line buffer of FIG. 6 between defined limits. The Run Command includes a 7 bit field data word which is the word written into the cells. This command also includes an end line bit and a two bit write mode control field. The "d-align" bit indicates whether the 7 bit data word shown in this command is aligned in the L field of X field of the line buffer, as shown in FIG. 6, and is coupled to the data format register 131. There are two 10 bit fields in the Run command, one for the right origin and the other for the right limit, defining the start cell and end cell of the line buffer between which the 7 bit data word will be written.

The Sequential Run command is similar to the Run command; however, it includes a data format, 5 bit field which is coupled to the register 131 of FIG. 9. It also includes the right origin field. The last 10 bit field provides for the counting of data words (DW) selected from the RAM 35. A sequential run data format is shown on the last line of FIG. 23 and as can be seen, two data words can be obtained per 32-bit bus cycle.

The Context Switch command sets up the line buffer controller for a new object to be loaded and includes a 12 bit absolute origin field, a data mode bit, and a bit used to indicate the polarity of an embedded mask (E-polarity). The field 77 has been previously discussed. This command can also be used within an object to switch to a subobject as will be discussed later.

The Run Screen command is used, for example, to clear the entire screen. It includes a data format field and a 16 bit data field.

Figure 23:
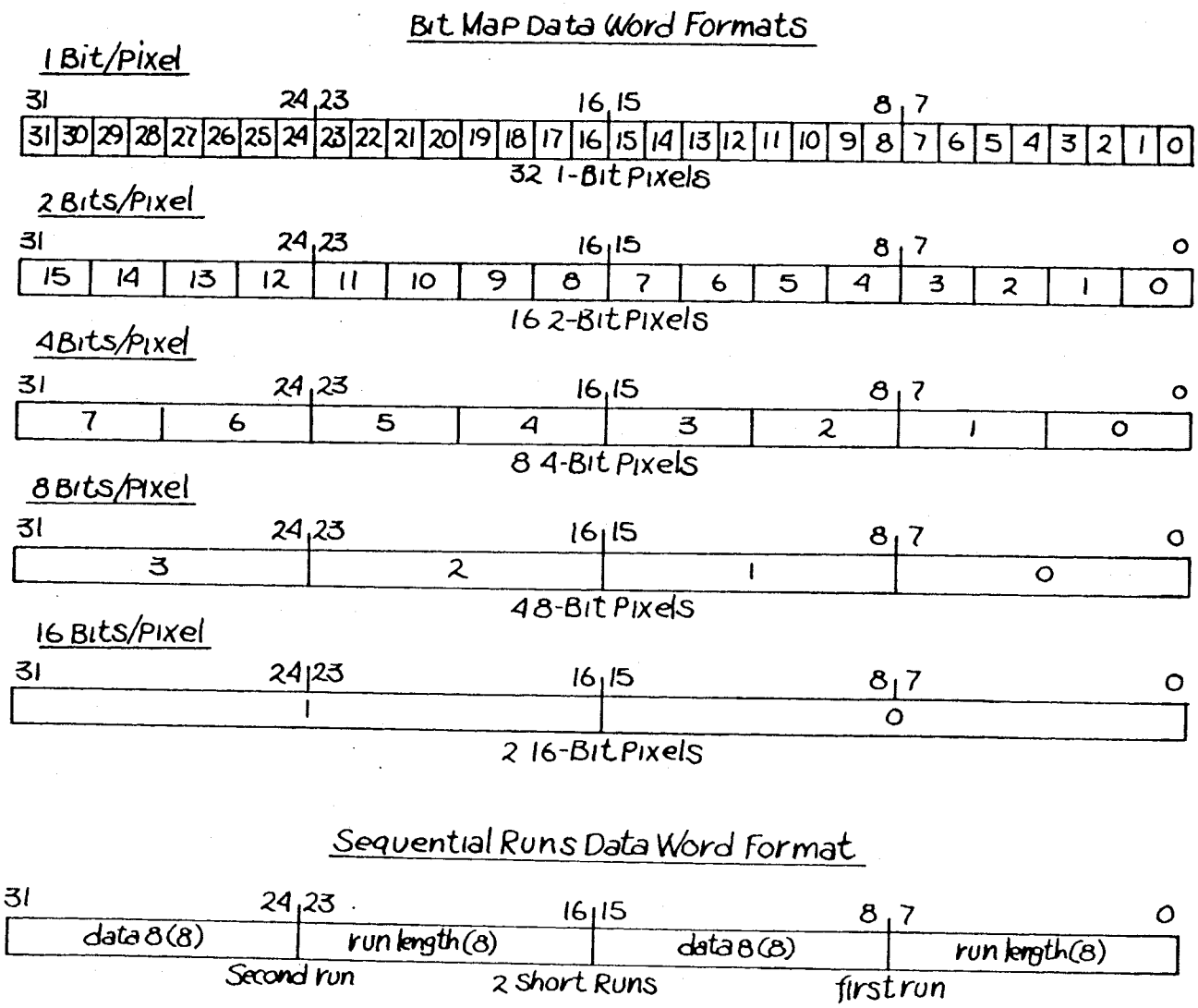
FIG. 23 is a diagram showing the currently preferred bit map and sequential runs data word formats.

In FIG. 23, there are five examples of the bit map data word formats. The "D-format" 5 bit field informs the controller of FIG. 9 of the particular format of the data being read from the RAM 35. The first line shows a 1 bit per pixel format and the last a 16 bit per pixel format.

LINE BUFFER CONTROLLER

Referring to FIG. 9, the controller includes a 12 bit absolute origin register 124, a 12 bit run start register 125, and a 12 bit position counter 126. (While only 10 bits, in theory, are needed for these registers, two additional bits are useful for "cropping".)

The absolute origin is coupled to the register 124, for example, from the Context Switch command. The right limit field from the Run command is a relative limit and needs to be converted to an absolute limit. This is done through adder 134. (The limit is coupled to bus 113.) This feature is particularly useful when subobjects are used as will be explained. The left limit is derived from the right origin and absolute origin through adder 135. The run start register 125 is used for the Sequential Run command and enables a determination of where the last run ended. The position counter 126 is used for the Bit Map command to provide the bit map write address. The left limit/address is coupled to bus 112.

As mentioned, the first field of the command word is coupled to the decoder 128 and once decoded, the instruction controls the operation of the controller through a finite state controller 132.

The data word count from the Bit Map command and Sequential Run command is coupled into counter 130 and counts down to control the counting of the data words. The format of the data words is selected through data format circuit 131 from the data format fields of these commands. These provide the write control signals for bus 116.

The line buffer read address counter 133 is synchronized with a horizontal counter of the display and permits the line buffer to be scanned for output to the display. These addresses are coupled to the cells through the bus 117.

The dispatch next signal (line 105) and clock rate signal form a "handshake" between the buffer and dispatcher to permit transfer of signals as is frequently done in computer systems.

TIMING BETWEEN CPU AND THE LINE BUFFER

Figure 24:
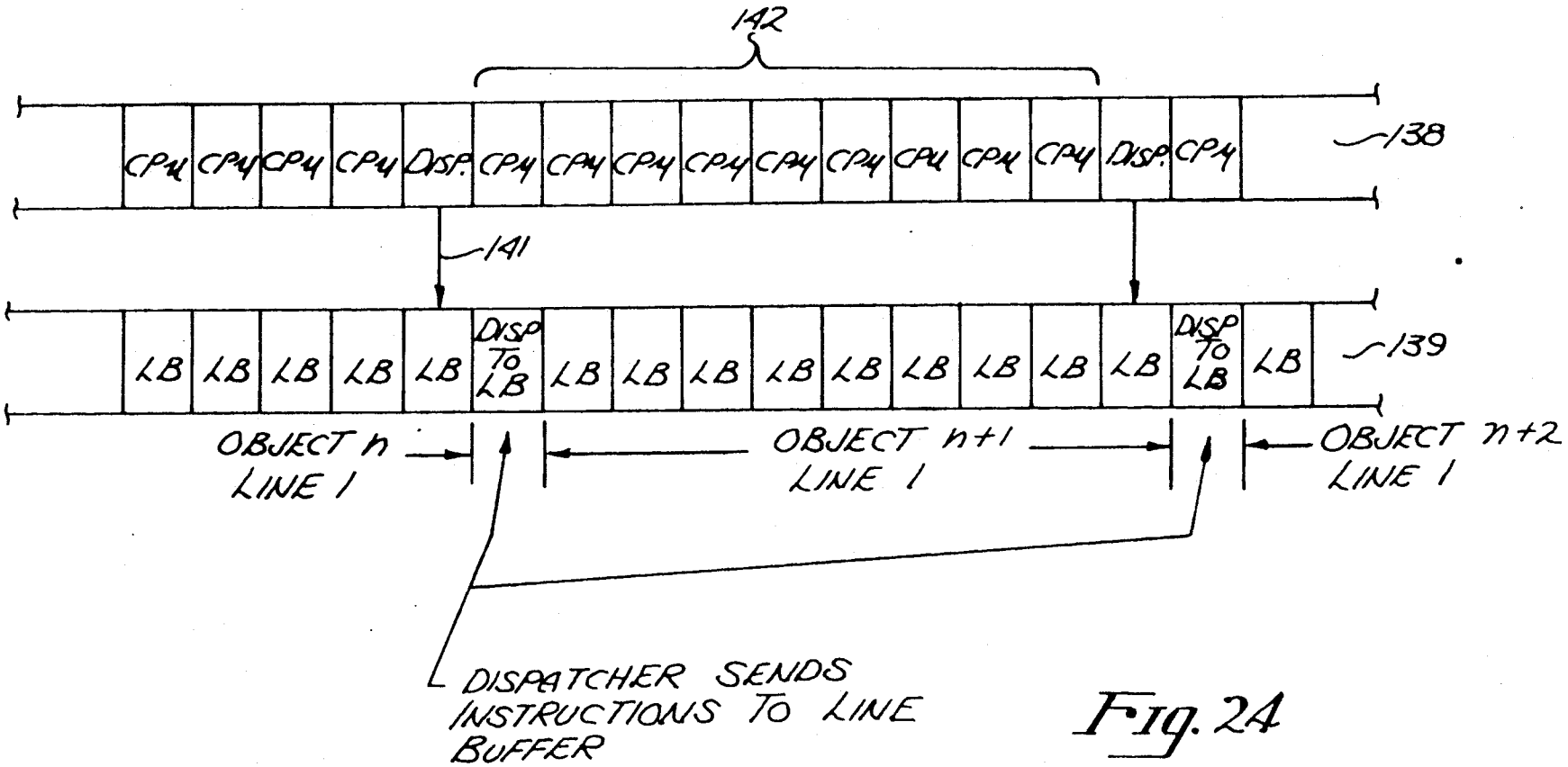
FIG. 24 is a timing diagram used in describing the operation of the present invention.

In FIG. 24, a series of CPU memory bus cycles 138 are shown corresponding to activity on buses 58 and 59 of FIG. 5 with a series of line buffer load cycles 139 corresponding to activity on buses 58 and 59 of FIG. 5. This illustrates the period of time during the loading of line 1 into the line buffer leading up to and following the transition between loading the line of object n and the line of object n+1 which crosses display line 1. These two sets of cycles may be asynchronous; the line buffer cycle and basic timing need not be synchronized with the CPU bus activity. Upon completion of the loading of one line of object n of line 1, in preparation of loading of one line of object n+1 of line 1, the dispatcher dispatches a signal to cause the shift register and the RAM 35 to be loaded with the data for the start of that line of the object and simultaneously on bus 60 couples certain instructions (four instructions) to the line buffer. These instructions, derived by the dispatcher from the ODT in memory 83 of FIG. 11 are first a Context Switch command as shown in FIG. 22, a Run Screen command to clear the mask bit across the line buffer, a Run command to set the mask bit for a viewport and finally, the first word of instruction for the object description for that line. Importantly, the CPU is not restricted from access to the RAM 35 through buses 58 and 59 during the period 142 even though data is loading simultaneously into the line buffer through bus 60. The only time the CPU's access to the RAM 35 is obstructed is during the brief period 141 at the transition between objects.

Figure 12A:
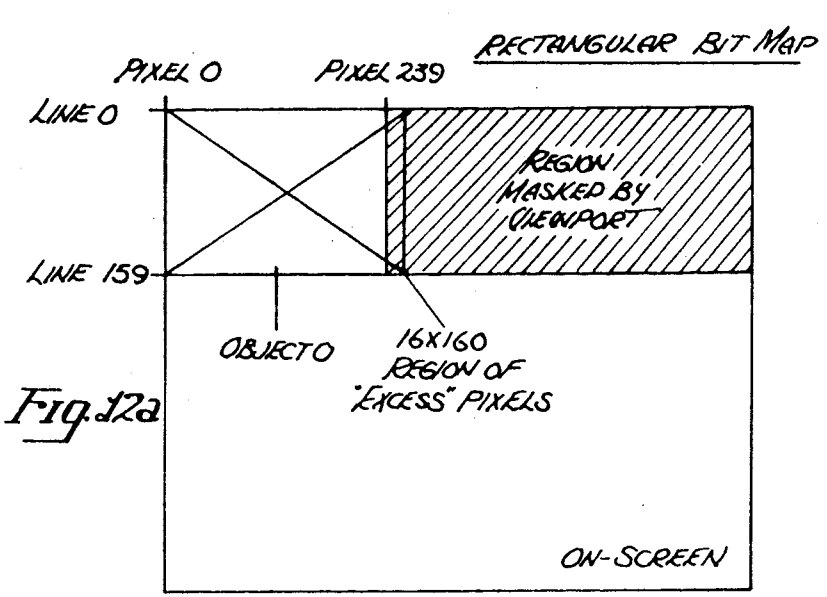
FIG. 12*a* illustrates a display and is used to describe the operation of the present invention for displaying a rectangular bit map.
Figure 12B:
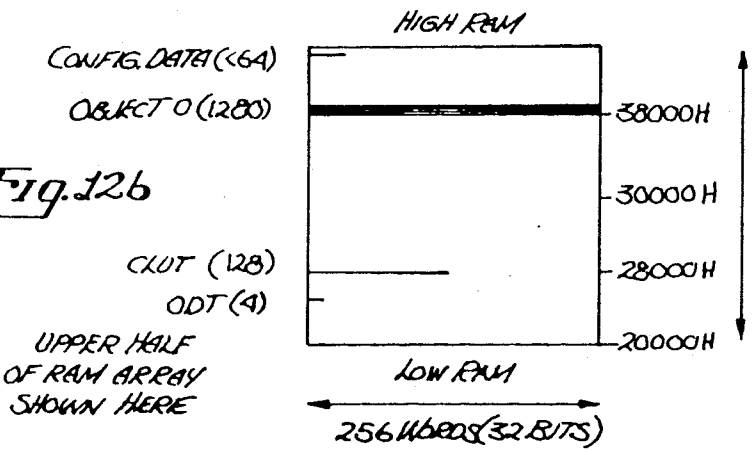
FIG. 12*b* is a diagram used to illustrate the memory storage used to obtain the display of FIG. 12*a*.

THE BASIC RECTANGULAR BIT MAP (FIGS. 12*a* AND 12*b*)

FIG. 12*a* shows a simple 1 bit/pixel bit map with dimensions of 240 horizontal and 160 vertical. Assume the content of the bit map is a text message of black letters on a white background. An "X" is shown in the figures to represent the display location of this Bit Map. A memory map is also shown in FIG. 12*b* detailing where in RAM is the display data. (The "H" following digits indicates the number's base is hexadecimal.)

First note that the upper half of a 256K RAM area is shown, and that the memory is divided into rows of 256 32-bit words (128 rows are shown, 256 rows are available). Notice also that the black area allocated for each block of data is shown in black.

In setting up this display, first it is decided where to store a color lookup table (CLUT) and the object dispatch table (ODT). Assume a CLUT is 128 words long, and can be placed anywhere in RAM provided that it does not cross a row boundary. It is shown at 28000H. The same row boundary constraint applies to the ODT, so it is placed at 26000H.

Next space is allocated for the bit map. The bit map can be set up as a linear array, one line following the next in memory, each line rounded up to an integral number of words. Since the horizontal dimension is 240 pixels, with 1 bit/pixel, 240 divided by 32=7.5 words are needed for each line. The storage needed for each line is rounded up to a whole word, so that is 8 words to hold each line. There are 160 lines, so the total RAM requirement for this bit map is 160×8=1280 words. This data is shown at 38000H and extends to 384FFH.

Now it is necessary to set up the dispatch table entry for the object using the format of FIG. 10.

A. Start Address

This parameter points to the beginning of the object description: address 38000H. Notice, however, that the number coded is DOOOH (38000H divided by 4) because a word address is specified in this field, not a byte address, since all instructions are aligned on 32-bit word boundaries.

B. Line Mode

This parameter specifies whether the line descriptions are fixed length or variable length. In the case of this example, either mode will work because the bit map line descriptions are of fixed length, so the length could be specified in fixed length mode, or the length can be computed by the dispatcher by specifiying variable length mode. For purposes of this example, a "1 " is specified for the fixed length mode.

C. Line Length

The length of each line description in RAM is 8 words. It is necessary to specify this parameter because a fixed length line mode is being used. Note that this parameter does not include the first word (that is, the "first word" field of the ODT entry for the object).

Start Line

This object begins at the first line of the on-screen area, line 0 (see diagram).

E. Object Height

The vertical dimension of this object is 160, so that is its height. The system requires that when this paramter is summed with the start line, the result is the end line, line 159. Thus, the amount coded for this parameter is the height minus 1, or 159.

F. Absolute Origin

This object's leftmost pixels are at pixel 0 of the display. The absolute origin can be any value that is 0 or smaller, since it must be less than or equal to the horizontal position of the left edge of the object, but for the sake of simplicity, 0 is used here.

G. Constant Word

Since only two colors are used in this example, black and white, assume they are stored at the beginning of the CLUT. Assume also that the 1 bit of the pixel data will be aligned with the LSB of the L-Byte in the line buffer cells. So, setting the lower 8 bits of the constant word to 0 will cause the 8 bits of CLUT pixel data to be all zeros except for the LSB, and thereby select between the first and second CLUT entries which are the colors black and white.

The most significant nibble of the constant word cannot be specified in this parameter, it is set to 0 when the dispatcher sets up the line buffer with the context of the object. The second-to-most significant nibble is not used in this example, so it is set to zero. So, the constant word parameter is set to OOOH.

H. Viewport Origin and Limit

These parameters specify what horizontal region of the bit map's pixel data will actually be displayed. The map is 240 pixels horizontally; it is rounded up to the nearest whole words, as if the bit map were 256 pixels horizontally. Since the system cannot determine where the real pixels of the last data word of a Bit Map command end, and where the "excess" 16 pixels begin, to prevent the displaying of these excess pixels, the viewport parameters are used to crop them off the display.

The viewport origin identifies the pixel where the real bit map begins, relative to the absolute origin. That pixel is 0 and the absolute origin is 0, so the viewport origin is 0−0=0. The viewport limit identifies the pixel where the real bit map ends relative to the absolute origin, plus 1. Pixel 239 is where the bit map ends and the absolute origin is 0, so the viewport limit is 239−0+1=240. The excess pixel region (see FIG. 12*a*) from pixel 240 to 255 now is masked since the viewport extends only between pixel 0 and 239. The desired horizontal dimension of 240 is thus achieved.

I. Display Mode

For this example, X, L are used rather than RGB. Therefore, the display mode bit is 0.

J. Embedded Mask Polarity

The embedded mask function is not used, therefore the polarity need not be defined.

K. First Word

This word holds the Bit Map instruction and makes the linear bit map array RAM organization possible. When a line of data is read from RAM into the line buffer, first, the buffer is configured with the relevant parameters listed above, and then the first word (treated as a command word) is used. Only then will the rest of the line description from RAM be used. In this example the first word contains a Bit Map command. A Bit Map command is followed by data words containing the pixel data of the bit map. These data words will be found, in this case, starting with the beginning of the portion of the line description in RAM which is where the linear bit map array is stored.

Starting with the first line of the object, the object is dispatched (that is, the dispatcher initiates the loading of the object's description for that line into the line buffer) at line 0, and the line buffer is configured in accordance with the dispatch table entry parameters. Then, the first word, the Bit Map command detailed in the preceding paragraph, is taken and executed. The line buffer is prepared for a bit map and expects 8 data words (256 1 bit pixels) to be fed in to described the bit map. The start address points to the first of these data words, indeed, the first word of data for the linear bit map array, and it and the following 7 words are loaded to make up the first displayed line for the object.

On the second line, the CPU again configures the line buffer and again executes the same first words, and the line buffer again expects 8 words of bit map data. Only this time, the start address from the dispatcher points to the 9th data word. It was incremented by the value in the line length parameter: 8 (see FIG. 10). The data words 9–16 (assuming numbering from 1), are provided for the second display line of the object. Note the 9th through 16th words of the linear bit map array correspond exactly to the second line of the bit map.

This process continues loading in each successive line of bit map data until the end of line of each line of the object is reached. Note that the same Bit Map instruction stored in the ODT is used for every line because the bit map object used in this example happens to be rectangular.

Figure 13A:
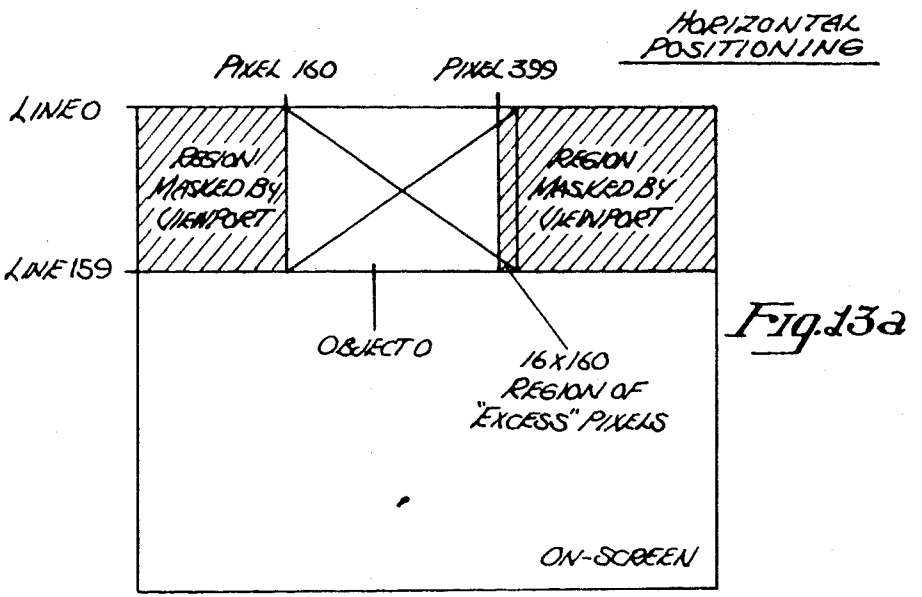
FIG. 13*a* illustrates a display and is used to describe the operation of the present invention for horizontal positioning.
Figure 13B:
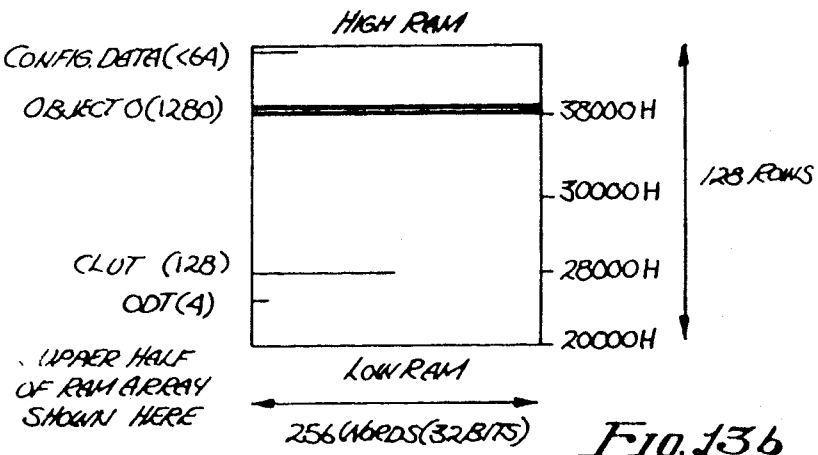
FIG. 13*b* is a diagram used to illustrate the memory storage used to obtain the display of FIG. 13*a*.

HORIZONTAL POSITIONING (FIGS. 13*a* AND 13*b*)

Assume that it is necessary to move the object of FIG. 12*a*. A fundamental manipulation is the positioning of the object in display space. Positioning is divided into two separate steps, horizontal and vertical. Consider first the horizontal positioning (vertical positioning is discussed in the next section). Assume, for example, the object is to be repositioned by 160 pixels to the right. Notice that the display data is identical to that of the object in its original position of FIG. 12*a*; the data is not moved in RAM 35 to reposition the object. Rather, the absolute origin parameter in the dispatch table entry is changed.

Whereas the absolute origin was set to 0 in the previous section, it is set to 160 here. Now, the horizontal positioning within the object description is all referenced to 160 rather than to 0 and everything accordingly shifts 160 pixels to the right.

Notice that the viewport defined by the viewport origin and viewport limit has shifted along with the rest of the object, so the excess pixels are still appropriately masked. This is because these parameters are referenced to the absolute origin and are not offset by 160 as well. Also note, however, that a region is present to the left of the object which is masked. It does not affect the display in this example because nothing can be written to the left of the obsolute origin anyway, but it comes into play in an example below.

This object could be moved from its original position to this new position (by the CPU, for example) at any time, yet the display transition would occur between frames. That is to say, if at mid-frame, halfway through displaying this object, it is moved by the CPU by the absolute origin parameter being changed in RAM 35, the rest of the object in that frame will still be drawn with the old absolute origin parameter.

Figures 14A, 14B, 15A, 15B:
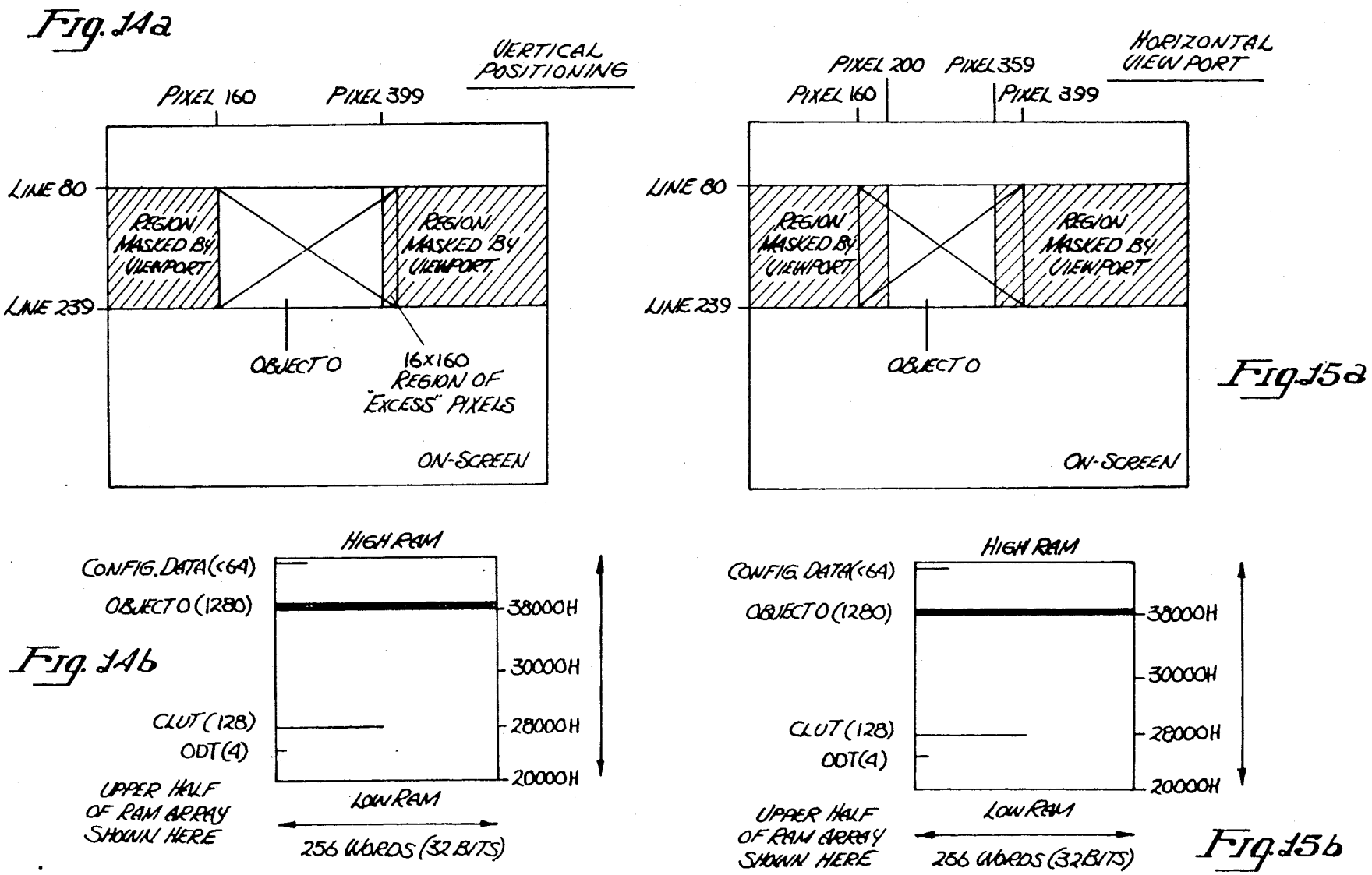
FIG. 14*a* illustrates a display and is used to describe the operation of the present invention for vertical positioning.
FIG. 14*b* is a diagram used to illustrate the memory storage used to obtain the display of FIG. 14*a*.
FIG. 15*a* illustrates a display and is used to describe the operation of the present invention for horizontal view port.
FIG. 15*b* is a diagram used to illustrate the memory storage used to obtain the display of FIG. 15*a*.

VERTICAL POSITIONING (FIGS. 14*a* AND 14*b*)

To reposition the object of FIG. 12*a* vertically, it is only necessary to change the start line parameter. If the object's first line is to be line 80, then the simple change of the start line parameter to 80 from its current value of 0 is made. The CPU then loads the first line description at line 80, and each successive line description is loaded with each successive line. The resulting image is shown in FIG. 14*a*.

The memory layout remains exactly the same as shown in FIG. 14*b*; the previous horizontal positioning (FIG. 13*a*) is not at all affected by this vertical change.

As with the horizontal change, no matter when the start line parameter is changed, the vertical shift will occur cleanly between frames.

HORIZONTAL VIEWPORTS (FIGS 15*a* AND 15*b*)

The viewport mechanism can be used for more than just masking excess pixels. Consider the display of FIG. 15*a*.

Here deliberately masking of some of the real pixels of the bit map is shown for object 0. This is logically what occurs when a window is sized down horizontally on, for example, an Apple Macintosh computer, so that it is smaller horizontally than the bit map that it holds and a horizontal scrolling mechanism, for example, is used to view different parts of the bit map.

Once again, the memory layout is unchanged. The whole effect is controlled by the dispatch table entries: mainly, viewport origin, and viewport limit. The left mask region is used here to mask off some pixels, whereas in the previous example it was not used, and the right mask region is used to mask off some real pixels as well as the excess pixels. The viewport position and size is controlled as follows: the viewport origin points to the pixels on the left edge of the viewport, relative to the absolute origin, and the viewport limit points to the pixels on the right edge of the viewport, plus 1 and relative to the absolute origin. In this case the viewport origin is $200-160=40$, and the viewport limit is $359-160+1=200$.

As in changing position, regardless of when the parameter change occurs, the display change of the object occurs between frames. But, both the parameters must be changed before a frame is displayed. To guarantee that it will not occur that one frame will be displayed with the new viewport origin, but with the old viewport limit, both fields must be written in one, uninterruptable memory cycle.

Figure 16A:
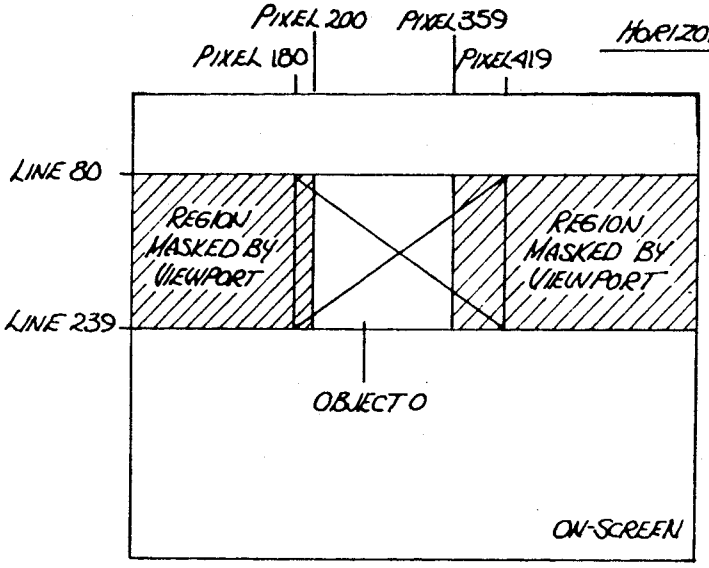
FIG. 16*a* illustrates a display and is used to describe the operation of the present invention for horizontal scrolling.
Figure 16B:
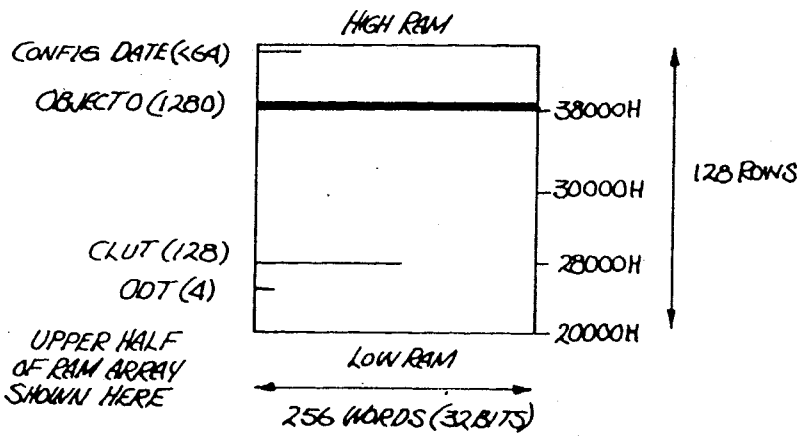
FIG. 16*b* is a diagram used to illustrate the memory storage used to obtain the display of FIG. 16*a*.

HORIZONTAL SCROLLING (FIGS. 16*a* AND 16*b*)

If the bit map were a window, such as in the abovementioned MACINTOSH computer, then it is necessary to support a horizontal scrolling effect within the horizontal viewport. To achieve this effect, the viewport is not moved, rather the object is moved. Hence, all that is changed is the relative origin field of the Bit Map instruction in the first word as contained in the ODT entry, and the bit map will move without disturbing the viewport. If the relative origin is changed from 0 to 20, the display of FIG. 16*a* results (again, note the display-data in RAM remains the same).

Scrolling to the left of the absolute origin cannot be done. So, if a scroll to the left of the absolute origin is needed, the absolute origin must be moved to the left with the relative origin of the Bit Map instruction and that of the viewport origin and limit adjusted to compensate.

Figure 17A:
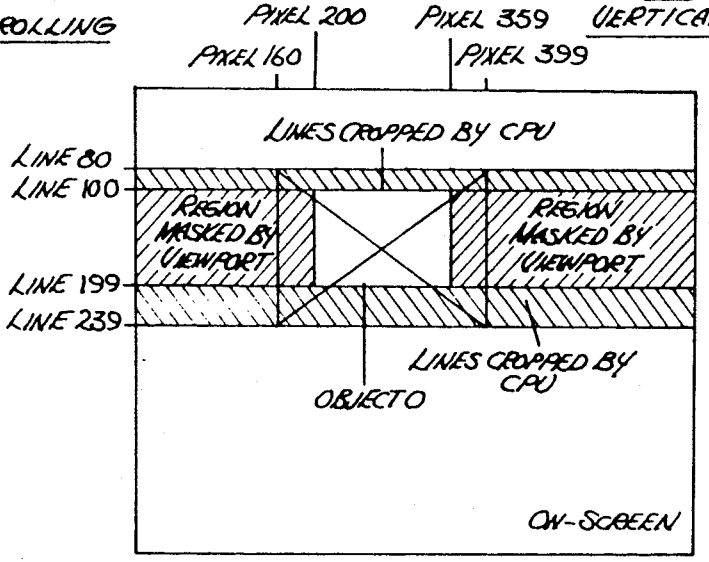
FIG. 17*a* illustrates a display and is used to describe the operation of the present invention for vertical view port.
Figure 17B:
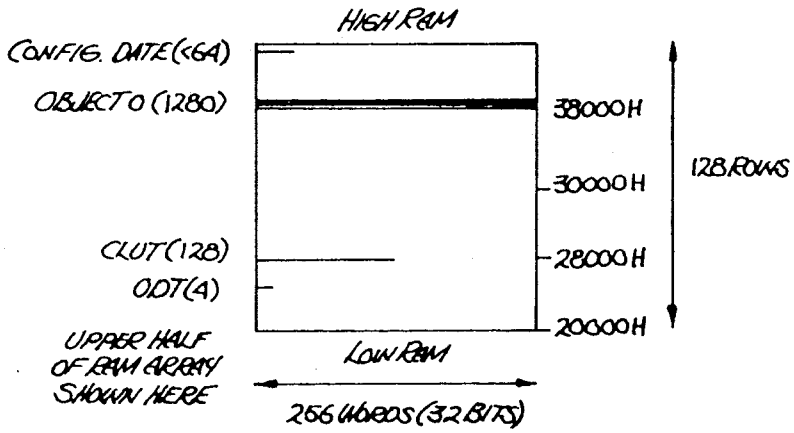
FIG. 17*b* is a diagram used to illustrate the memory storage used to obtain the display of FIG. 17*a*.

VERTICAL VIEWPORT (FIGS. 17*a* AND 17*b*)

In FIG. 17*a*, the object is masked vertically as well as horizontally, that is, it has a vertical viewport as well as a horizontal one. Unlike horizontal viewports, direct support is not provided and the vertical viewports must be generated by the CPU that prepares the ODT entry for this object.

The way this is achieved is that this CPU changes the object description so that it describes only the lines of the object that are to be displayed. That is to say, since the vertical viewport of FIG. 17*a* extends from line 100 to line 199, then the object description will only contain those lines of the object. Then, the system simply will not display those lines "masked" by the viewport.

In this example, the visible lines of the object are from its 20th line to its 119th line, since 20 lines from the top and 40 lines from the bottom are masked by the viewport. The start address parameter is changed to point to the line description for the 20th line, since this is where the new object will start. Then, the start line parameter is changed to line 100, the first line in the display of the new object. And, finally, the object height parameter is set to 99 to reflect the new height of the object. The result is the displayed region shown in the center of FIG. 17*a*.

Figures 18A, 18B, 19A, 19B:
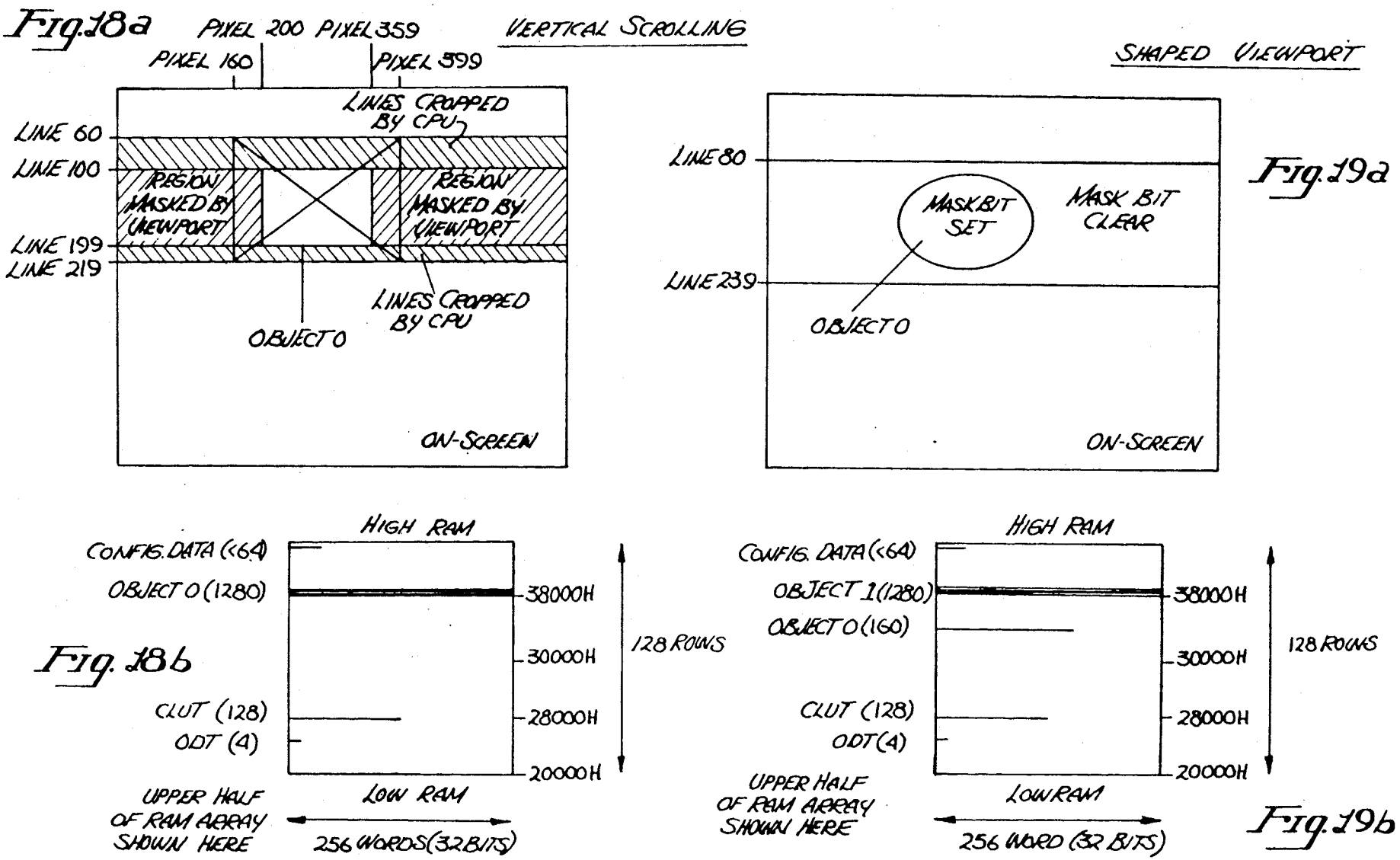
FIG. 18*a* illustrates a display and is used to describe the operation of the present invention for vertical scrolling.
FIG. 18*b* is a diagram used to illustrate the memory storage used to obtain the display of FIG. 18*a*.
FIG. 19*a* illustrates a display and is used to describe the operation of the present invention for a shaped view port.
FIG. 19*b* is a diagram used to illustrate the memory storage used to obtain the display of FIG. 19*a*.

VERTICAL SCROLLING (FIGS. 18*a* AND 18*b*)

Just as the horizontal scroll mechanism in a MACINTOSH computer caused horizontal scrolling, the vertical scroll mechanism causes vertical scrolling. The effect of a vertical scroll 20 lines up is shown in FIG. 18*a*.

The vertical scroll requires again, moving the object while keeping the viewport fixed. The object is positioned vertically to the desired new position, starting at line 60. Then, a new vertical viewport is set just as before, except it starts at the 40th line of the object and ends at the 199th line.

Figure 19C:
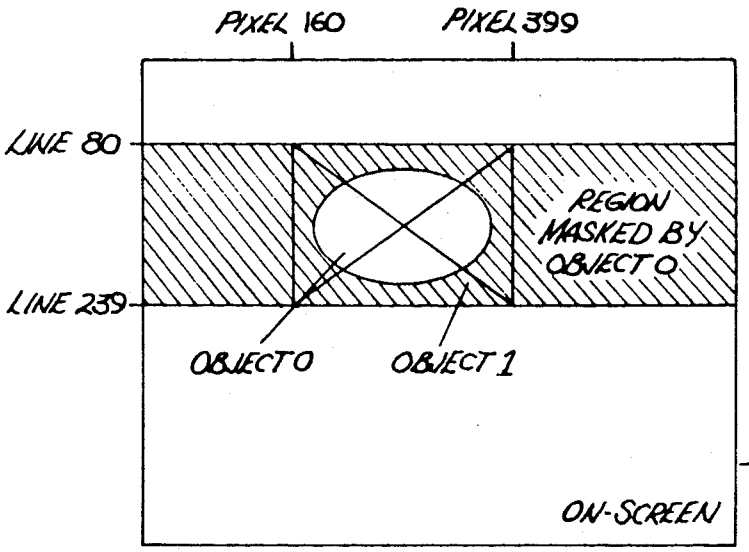
FIG. 19*c* is an additional illustration of a display used to describe the shaped view port of FIG. 19*a*.

ARBITRARILY SHAPED VIEWPORTS (FIGS. 19*a*, 19*b* AND 19*c*)

A viewport which is not rectangular is sometimes needed. This is obtainable by defining a 1 bit/pixel object that is used as a mask. This object (Object 0 for explanation) is placed directly behind (i.e., at the next lower priority) the object to which the viewport is applied (referred to for this example as object 1). The write mode "mask bit" is used for object 0, so that object 0 is loaded into the mask bit in the cells (107 of FIG. 6) of the line buffer. Where object 1 is to be masked, 0's are used for the bit, otherwise ones are written into the cells. Then in the dispatch table entry for object 1, the viewport limit is set to 0. This disables the automatic viewport mechanism from interfering with the viewport when object 1 is dispatched.

Object 0 is created in the following way: (1) the automatic viewport is used to mask all pixels on the screen, (2) a single Run command for each line is now used to clear the mask bits from the left to the right side of the ellipse for that line (note that each line's run is different so the first word of the ODT entry cannot be used for the Run command), (3) a NOP (no operation) instruction (obtained by a null configuration of a valid instruction) is specified for the first word with a Run command used as the first (and only) word of each line description in RAM (that is, the second instruction total of each line description). For those lines above and below the ellipse, a NOP is set for that word.

The object 0 mask is shown in FIG. 19*a* and the resulting display from the bit map of the previous examples overlaid on top of object 0 is shown in FIG. 19*c*. Only the area of the bit map in the ellipse will be displayed. The memory map in FIG. 19*b* shows memory utilization. Note that object 0 of the previous example is object 1 in this example.

Figure 20A:
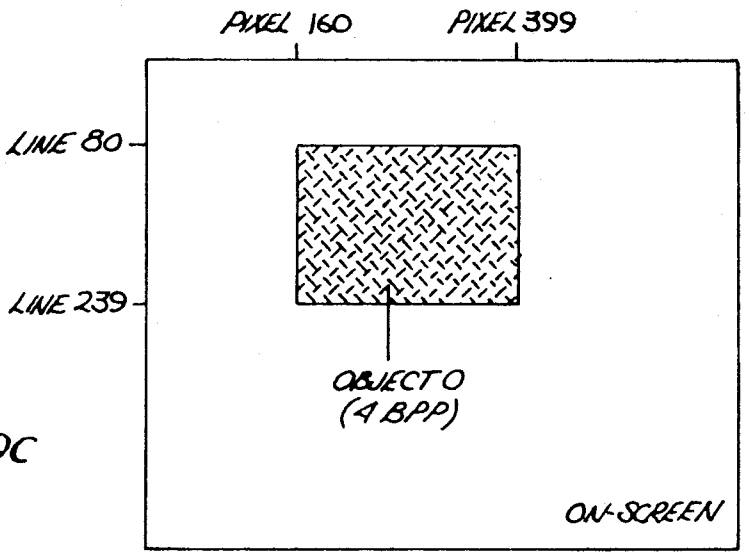
FIG. 20*a* illustrates a display and is used to describe the operation of the present invention for an embedded mask.
Figure 20B:
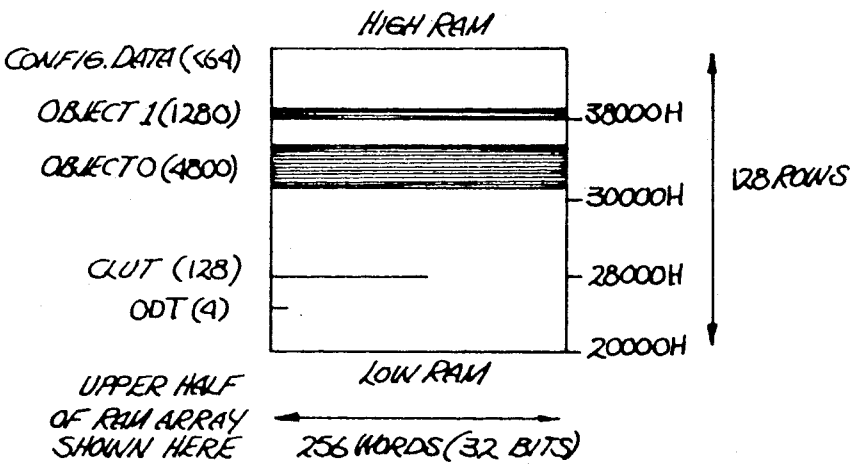
FIG. 20*b* is a diagram used to illustrate the memory storage used to obtain the display of FIG. 20*a*.
Figure 20C:
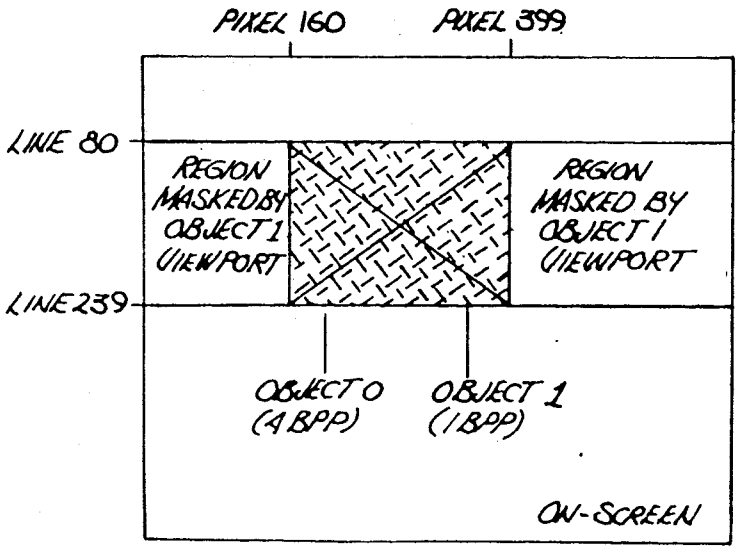
FIG. 20*c* is an additional diagram used to describe the embedded mask of FIG. 20*a*.

EMBEDDED MASKS (FIGS. 20*a*, 20*b* AND 20*c*)

It is sometimes necessary to overlay a background object with text bit map object with the background showing through between the letters. This can be achieved by using a background object, and then by using a custom mask object which corresponds to the text's pattern, and finally by using the text object on top of the mask. There is, however, a simpler way, using embedded masks.

The text object in this example is a 1 bit/pixel bit map, and it so happens that to make a custom mask, a 1 bit/pixel bit map with exactly the same pattern is needed. Using this fact, the bit map loads into the line buffer and the masking operation with the same text bit map can be combined.

First the background object is made (e.g., 240 by 160 and 4 bits/pixel) as shown in FIG. 20*a* as object 0. Notice that it has no horizontal mask. This is because at 4 bits/pixel with a horizontal dimension of 240 exactly 30 words per line (with no excess pixels) are used. (The horizontal viewport is disabled for convenience.) If it is desired that 16 colors mapped by this bit map be separate from the 2 colors of the text bit map, the lower byte of the constant word is set so that when it is combined with the 4 bits of the pixel data the resulting index points to a convenient place in the CLUT.

The text bit map from the previous examples can be used to activate the embedded mask function. First, the white background masks must be made not to overwrite in the line buffer and the black letters not to mask, rather to overwrite. This is determined by the "e" polarity bit in the dispatch table entry. If black is 1 and white is 0, then 1 is used to permit writes, thus the e polarity is set to 1. Now, the Bit Map command in the first word is set so that the embedded mask mode is selected with the e-mode bit to 1.

Note the embedded masks does obviate the need to have a horizontal viewport to mask off the excess bits of this object. This masking function works with the mask bit in the pixel storage cell and is independent of the embedded mask function. If either or both masks are inhibiting writes at a given pixel, then the write will be inhibited.

The resultant display is illustrated in FIG. 20*c*. The display would really show text on top of a pattern, with the pattern showing through the spaces between the letters. The memory utilization is shown in FIG. 20*b*.

RUNS AND COMPLEX OBJECTS (FIGS. 21*a*, 21*b*, 21*c* AND 21*d*)

This section shows examples of special case objects whose object descriptions can be specified in ways which economize memory, time and capacity. It should be noted that all objects shown in this section can be specified using the rectangular bit map discussed in the previous sections with suitable masking. However, special case objects occur commonly enough and the savings are substantial enough that the special capabilities discussed in this section are useful.

All the special case objects considered in this section are largely made up of Runs, and such objects are referred to as run-class objects. The main capability that makes run-class objects worthwhile is that of the fully parallel run. These are implemented by having all pixels that make up the run written simultaneously to the line buffer.

BACKGROUNDS (SINGLE COLOR)

One application area in which run-class objects immediately show their worth is that of the generation of backgrounds. Backgrounds that are all of one color that would otherwise be represented by a large 1 bit/pixel bit map, now can be drawn with a single Run per line. Large backgrounds with static objects (e.g., trees, mountains, clouds, sky) can be specified with a handful of runs per line, requiring orders of magnitude less memory and line buffer write time than a comparable bit map representation. In fact, backgrounds even larger than the screen can be efficiently stored and manipulated to give the illusion of the screen being a viewport into another area. (Compare FIGS. 21*a* and 21*c*.)

To do this the dispatch table entry is set at the priority at which the background is to exist. Then the start line is loaded with the first line of background; object height with its height −1; absolute origin to the background's left border; viewport origin, and limit both to 0; constant word and display mode as desired; start address, e-polarity, line mode and line length to any value. Now, the first word is loaded with a Run command, setting R-origin to 0; R-limit to the horizontal dimension of the background; end-line to 1; and data-7, W-mode and D-align as desired.

On each line of the object, the one Run command in the first word will execute, generating a run from the left side of the background to the right. Note no space in RAM is allocated to each object, since each is generated fully by the first word, except of course, for the 4 words in the dispatch table entry.

BACKGROUND (MULTIPLE COLORS)

For purposes of discussion, small objects grouped together to make up a single composite object shall be referred to as subobjects. An object which contains 2 or more subobjects shall be referred to as a complex object. A complex object (a forest scene) is shown, with each subobject identified with a letter in FIG. 21*a*.

A subobject may be made up of bit maps, runs, or both, and there may be any number of subobjects in an object. In the forest scene of FIG. 21*a*, there are 13 subobjects, each a solid region of one color represented by Runs. Subobjects may also overlap, and in fact, in FIG. 21*a*, subobject A is a simple rectangle—the complex region shown in the figure for subobject A results from the overlaps of the subobjects in front of subobject A.

To generate the object description for the forest scene, the subobjects are ordered by subpriority (the overlap priority of the subobjects), background to foreground. ("A" is the background-most subobject, M the foreground-most object.)

An object description, its line descriptions referenced to the single absolute origin of the complex object is generated. Since the left border of the complex object is at pixel -100, its absolute origin is set to −100. And since each subobject in this complex object is a contiguous region of one color, each subobject line description can be repeated by a single Run command. Subobjects A, B, C, D, E, J, K and L are all rectangles, so for each one's line descriptions, the same Run command (starting at the rectangle's left edge and ending at its right edge), can be specified. For example, subobject B is 40 pixels wide, 220 lines high, and has its left edge at pixel -60. It is described by 220 Run commands, each with the relative origin set to 40 (−60−(−100)) and the relative limit set to 80 (−21−(−100)+1).

Subobjects F, G, H and I are all circles, however, each is vertically symmetric across its center, and therefore line descriptions for the top half can be reversed in their order to generate the bottom half. To determine the top half's set of Runs, the left and right edge of the circle on each line is determined by using simple geometry, and then a Run command is made for each line with the relative origin at the left edge and the relative limit at the right.

Subobject M is a triangle, and as with the circle subobjects, geometry is used to determine the left and right edges of each line, then that information is used to find the relative origin and relative limit of the Run command for its line descriptions.

Figures 21A, 21B, 21C, 21D:
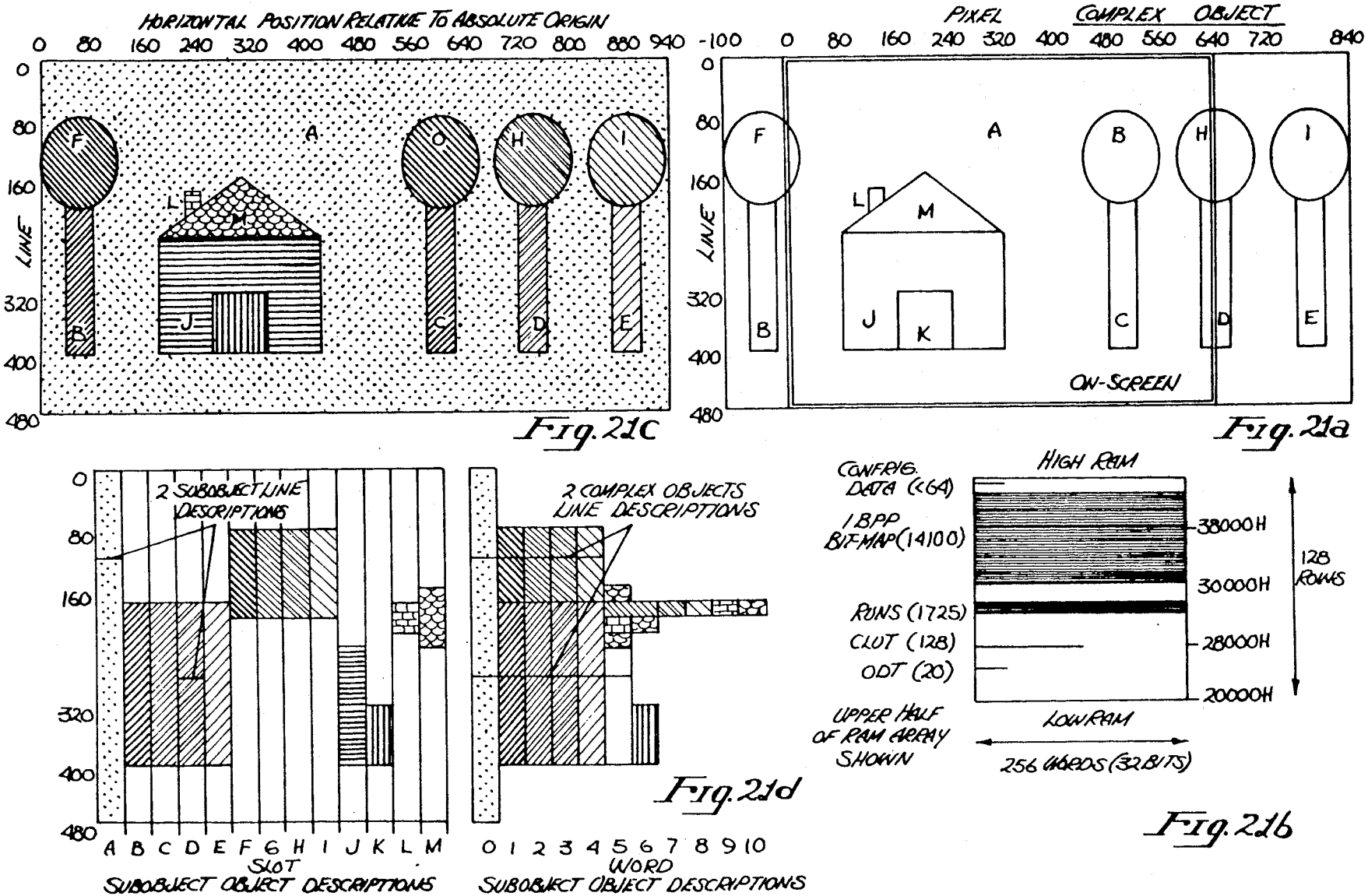
FIG. 21*a* illustrates a display and is used to describe the operation of the present invention for a complex object.
FIG. 21*b* is a diagram used to illustrate the memory storage used to obtain the display of FIG. 21*a*.
FIG. 21*c* is an additional diagram used to describe the complex object of FIG. 21*a*.
FIG. 21*d* is a diagram used in conjunction with the description of the storage of the complex object of FIGS. 21*a*, 21*b* and 21*c*.

To assemble these various subobject's object descriptions into the one complex object's object description for the entire forest scene, it is necessary to interleave the various subobject line descriptions line by line, with the lowest subpriority subobject's line description on each line first, and the highest subpriority subobject's line description last. This is illustrated in FIG. 21*d*. Compare, for example, the 480 lines of FIG. 21*d* to the 480 lines of the forest scene. Notice that the vertical size and position of the patterned bar representing the object description for each subobject corresponds with the vertical size and position of the subobject itself in the forest scene. This is because the object description of each subobject only exists on those lines where the subobject exists. Thus, each line of a slot (see line numbering to the left) holds the line description corresponding to the same line of the slot's subobject in the forest scene (two sample subobject line descriptions are highlighted in the diagram).

Since each slot corresponds to a subpriority level, the line descriptions on each line are in proper order for interleaving, left to right, into a line description of the complex object (eliminating the empty slots). The diagram on the lower right shows the empty slots eliminated, and packed to the left. This then is a representation of the interleaved subobject line descriptions making up the line descriptions for the complex object.

Notice that subpriority is handled in the line buffer by overwriting as each subobject line description is loaded into the line buffer. The lowest subpriority subobjects are written to the line buffer first (since they are first in the complex object line descriptions), and they are overwritten by the higher subpriority subobjects that overlap them.

The object descriptions have the first word of each line description stored in common for all lines of the object in the dispatch table entry. So, if every line description of an object description starts with the same instruction command word, then the command word can be placed in the "first word" and thereby avoid having to store it individually in RAM for every line of the object description. Examining the packed diagram and the forest scene, it can be seen that on every line, the first word is the same: it is the single word of a subobject A's Run instruction. On every line of the complex object subobject A generates a Run instruction with its relative origin at 0 and its relative limit at 940. Therefore, by putting this instruction in the first word, it can directly save 480 words (1 word for each line) of RAM.

Thus, a video display apparatus has been described.

I claim:

1. A video display apparatus comprising:

a memory for storing data representative of a plurality of objects for display;

a buffer for composing a line of pixel data for said display, said buffer being coupled to said memory;

a control means for controlling accessing of said data in said memory such that one line of data for each of said objects is read into said buffer to permit said composing of said line of pixel data for said display;

said buffer comprising a plurality of cells which are simultaneously addressible by said control means, each cell being coupled to receive data from said memory on a plurality of data lines and each cell providing storage for said pixel data for a plurality of spaced-apart pixels such that data transferred from said memory over said data lines may be simultaneously read into said cells for a plurality of adjacent pixels; and, each of said cells includes a comparator associated with the storage of data for each of said pixels for comparing address signals from said control means with stored values to determine if data from said data lines is to be written into said cells.

2. The video display apparatus defined by claim 1 wherein said stored value represents the pixel's position in a video line.

* * * * *